US007694463B2

(12) United States Patent
Lanahan

(10) Patent No.: US 7,694,463 B2
(45) Date of Patent: Apr. 13, 2010

(54) STRUCTURED POLYHEDROID ARRAYS AND RING-BASED POLYHEDROID ELEMENTS

(76) Inventor: Samuel J. Lanahan, 2043 NW. Johnson St., Portland, OR (US) 97209

( * ) Notice: Subject to any disclaimer, the term of this patent is extended or adjusted under 35 U.S.C. 154(b) by 46 days.

(21) Appl. No.: 12/176,147

(22) Filed: Jul. 18, 2008

(65) Prior Publication Data

US 2009/0263615 A1 Oct. 22, 2009

Related U.S. Application Data

(60) Provisional application No. 61/125,120, filed on Apr. 21, 2008.

(51) Int. Cl.
*E04B 7/08* (2006.01)
*E04H 12/18* (2006.01)
*A63H 33/06* (2006.01)

(52) U.S. Cl. ..... 52/81.1; 52/DIG. 10; 52/81.2; 52/81.3; 52/646; 446/118

(58) Field of Classification Search ..... 52/DIG. 10, 52/81.1, 81.2, 81.3, 646; 446/107, 117, 118, 446/124, 125; 434/81, 82, 211
See application file for complete search history.

(56) References Cited

U.S. PATENT DOCUMENTS

| | | | | |
|---|---|---|---|---|
| 2,682,235 | A | 6/1954 | Fuller | |
| 3,063,521 | A | 11/1962 | Fuller | |
| 3,169,611 | A | 2/1965 | Snelson | |
| 3,354,591 | A | 11/1967 | Fuller | |
| 3,586,645 | A * | 6/1971 | Granger | 521/78 |
| 3,722,153 | A | 3/1973 | Baer | |
| 3,866,366 | A | 2/1975 | Fuller | |
| 3,925,941 | A | 12/1975 | Pearce | |
| 3,953,948 | A * | 5/1976 | Hogan | 52/81.4 |
| 3,970,301 | A * | 7/1976 | Lehmann | 482/35 |
| 4,207,715 | A * | 6/1980 | Kitrick | 52/81.4 |
| 4,238,905 | A * | 12/1980 | MacGraw, II | 446/92 |
| 4,701,131 | A * | 10/1987 | Hildebrandt et al. | 434/211 |
| 4,719,726 | A | 1/1988 | Bergman | |
| 4,723,382 | A | 2/1988 | Laivani | |
| 5,524,396 | A | 6/1996 | Lalvani | |
| 5,906,530 | A | 5/1999 | Lindsey | |
| 6,282,849 | B1 * | 9/2001 | Tuczek | 52/81.1 |

(Continued)

FOREIGN PATENT DOCUMENTS

DE 3306051 A1 * 8/1984

(Continued)

OTHER PUBLICATIONS

International Search Report and Written Opinion for PCT/US05/31145.

(Continued)

*Primary Examiner*—Richard E Chilcot, Jr.
*Assistant Examiner*—Babajide Demuren
(74) *Attorney, Agent, or Firm*—Klarquist Sparkman, LLP

(57) ABSTRACT

An array comprises a plurality of ring elements and a plurality of mortar elements. The ring elements comprise polyhedroids interconnected to one another to form a closed ring shape, with the polyhedroids having a generally polyhedral shape. The mortar elements are configured to connect ring elements to each other.

16 Claims, 26 Drawing Sheets

U.S. PATENT DOCUMENTS

| | | | | |
|---|---|---|---|---|
| 6,379,212 | B1 | 4/2002 | Miller | |
| 6,531,107 | B1 | 3/2003 | Spencer et al. | |
| 6,672,789 | B2 | 1/2004 | Chen | |
| 6,739,937 | B2 | 5/2004 | Snelson | |
| 6,841,456 | B2 * | 1/2005 | Hersee et al. | 438/478 |
| 6,965,026 | B2 * | 11/2005 | Zaworotko et al. | 536/119 |
| 2001/0016283 | A1 | 8/2001 | Shiraishi et al. | |
| 2004/0155518 | A1 | 8/2004 | Schlanger | |
| 2006/0160446 | A1 * | 7/2006 | Lanahan | 442/59 |
| 2006/0234600 | A1 * | 10/2006 | Pacheco | 446/124 |
| 2007/0256370 | A1 * | 11/2007 | Whittingham | 52/81.1 |

FOREIGN PATENT DOCUMENTS

| | | | |
|---|---|---|---|
| JP | 04330140 A | * | 11/1992 |
| WO | 2006/028903 | | 3/2006 |

OTHER PUBLICATIONS

International Search Report and Written Opinion for PCT/US06/31940.

Fuller, E.B., "Allspace-Filling Tensegrity Arrays," *Synergetics*, pp. 428-431 (1975).

Pearce, Peter, Structure in Nature is a Strategy for Design, Ch. 11, "Infinite Spatial Networks from Equilateral Triangles," pp. 144-153 (1978).

Rittenhouse et al., "Filling in the Hexagonal Close-Packed Unit Cell," *Journal of Chemical Education*, http://jchemed.chem.wisc.edu/JCEWWW/Articles/FillingHCP/Filling HCP.ptml, 7 pp. (downloaded Jul. 17, 2008).

"Platonic Solid," http://mathworld.wolfram.com/PlatonicSolid.html, 6 pp. (downloaded Jul. 17, 2008).

* cited by examiner

STRUCTURED POLYHEDROID ARRAYS AND RING-BASED POLYHEDROID ELEMENTS

RELATED APPLICATION DATA

This application claims the benefit of U.S. Provisional Application Ser. No. 61/125,120 filed Apr. 21, 2008, the entirety of which is incorporated herein by reference.

FIELD

This application relates to novel structural elements and arrays, and in particular, to structural elements and arrays comprised of a plurality of polyhedral-shaped elements that are connected in a closed ring shape.

BACKGROUND

In geometry, an icosahedron is a polyhedron that is comprised of twenty faces. In a "regular" icosahedron each of the twenty faces forms an equilateral triangle. The regular icosahedron is one of the five Platonic solids, which have long since been recognized and appreciated by mathematicians for their aesthetic beauty and symmetry. The other four Platonic solids are a regular tetrahedron (pyramid with all faces being equilateral triangles), a regular hexahedron (cube), a regular octahedron (eight-sided figure with all faces being equilateral triangles), and a regular dodecahedron (twelve-sided figure with pentagonal faces).

Applicant's prior U.S. patent application Ser. No. 10/932,403 and U.S. patent application Ser. No. 11/579,307, both of which are incorporated herein by reference, disclose arrays that are comprised of discrete icosahedral elements with interconnecting elements in tension or connection networks along bias directions that interconnect the icosahedral elements.

As discussed in the Applicant's previous applications, polyhedron-based structures, such as icosahedrons, have been recognized to have superior strength-to-weight ratios and other characteristics that make them, at least theoretically, suitable for structural applications. For example, Buckminster Fuller is a well-known geometrist who, among others, pioneered the use of polyhedron-based structures in certain architectural applications, including the geodesic dome.

SUMMARY

Described below are embodiments and implementations of ring elements formed of polyhedroids, mortar elements that can be configured to connect various ring elements, and arrays and kits including ring elements and mortar elements.

In one embodiment, a structured and ordered array of at least two layers is disclosed. The array comprises a first array layer comprising a plurality of ring elements and a second array layer comprising a plurality of ring elements. The plurality of ring elements of the first array layer include at least a first ring element. The plurality of ring elements of the second array layer include at least a second ring element. At least one mortar element connects at least the first ring element to at least the second ring element so that the first and second ring elements are substantially held in position relative to one another. Each ring element comprises six polyhedroids interconnected to one another to define a substantially closed ring shape. Each polyhedroid has the same general geometric shape, and the geometric shape is selected from the group consisting of Platonic polyhedrons and Archimedean polyhedrons.

In specific implementations, the geometric shape of the polyhedroids has 5-fold symmetry. For example, the geometric shape of the polyhedroids can be an icosahedron or truncated icosahedron.

In specific implementations, the first array layer can be positioned below the second array layer and the at least one mortar element can have a portion that extends upwards and a portion that extends downwards from a horizontal plane. The horizontal plane is located at the mid-point between a vertical space defined by an upper surface of the first array layer and a lower surface of the second array layer.

In specific implementations, the first array layer can be positioned below the second array layer and the at least one mortar element can have extending members that extend upwards and downwards from a central plane of the at least one mortar element. The polyhedroids can have openings near an upper surface and a lower surface, with the openings configured to receive the extending members of the at least one mortar element to connect the at least one mortar element to the ring elements.

In specific implementations, the ring element can have an opening in the center of the closed ring shape. The array can be omni-extensible. An existing array can be increased in size by connecting additional ring elements and mortar elements without other modifications to the existing array. The ring elements can be are arranged in multiple, generally parallel layers. Each ring element can be offset from a ring element that is above or below it in an adjacent parallel layer.

In specific implementations, the at least one mortar element can comprise at least one spanning mortar element. The spanning mortar element can be configured to connect two ring elements in a single parallel layer. The spanning mortar element can also connect the two ring elements to another ring element that is above or below it in an adjacent parallel layer.

In specific implementations, the upper surface of each polyhedroid can form an upper face and the lower surface of each polyhedroid can form a lower face. Each of the upper and lower faces can have edges that define the upper and lower faces. Each edge of the upper and lower faces can also form an edge of an adjacent face with the adjacent faces each having edges that define the opening for receiving the extending members.

In another embodiment, a kit is disclosed. The kit comprises at least one ring element and at least one mortar element. The ring element comprises a plurality of spaced-apart polyhedroids and a plurality of connecting members. Each polyhedroid can have the same general geometric shape. The connecting members connect each polyhedroid to at least two adjacent polyhedroids so that the plurality of polyhedroids form a closed ring shape. The mortar element is configured to connect at least two ring members together so that the ring elements are substantially held in position relative to one another. Six polyhedroids can define the closed ring shape and each polyhedroid can have the same general geometric shape, with the geometric shape being selected from the group consisting of Platonic polyhedrons and Archimedean polyhedrons.

In specific implementations, the geometric shape of the polyhedroids has 5-fold symmetry. For example, the geometric shape of the polyhedroids can be an icosahedron or truncated icosahedron.

In specific implementations, the kit comprises at least a first ring element and a second ring element. The first ring element is capable of being coupled to a first side of the mortar element and the second ring element is capable of being coupled to a second side of the mortar element. The mortar element can further comprise a first extending member extending from the first side of the mortar element to couple the mortar element to the first ring element and a second extending member extending from the second side of the mortar element to couple the mortar element to the second ring element.

In specific implementations, the polyhedroids have a generally icosahedral shape, with the upper face having three edges. Each edge of the upper face forms an edge of an adjacent upper face, and the adjacent upper faces form the openings into which the first extending members extend. The mortar element can further comprise a first triangular element and a second triangular element. The first triangular element has three edges and the second triangular element has three edges. The first extending members can extend upwardly from the three edges of the first triangular element and second extending members can extend downwardly from the three edges of the second triangular element.

In specific implementations, each polyhedroid further comprises an upper face. The upper face is the uppermost surface of the polyhedroid. The mortar element can further comprise a facing element. The facing element can have the same general geometric shape as the upper face of the polyhedroids and can be configured to contact the upper face when the ring element is connected to the mortar element.

In specific implementations, the ring element can have an opening in the center of the closed ring shape.

In another embodiment, a ring element is disclosed. The ring element comprises a plurality of spaced-apart polyhedroids, with each polyhedroid having the same general geometric shape. A plurality of connecting members connect each polyhedroid to at least two adjacent polyhedroids so that the plurality of polyhedroids form a closed ring shape. The geometric shape of the polyhedroids is selected from the group consisting of Platonic polyhedrons and Archimedean polyhedrons, and six polyhedroids define the closed ring shape.

In specific implementations, the geometric shape of the polyhedroids has 5-fold symmetry. The geometric shape of the polyhedroids can be an icosahedron or truncated icosahedron.

In specific implementations, the ring element has an opening in the center of the closed ring shape. The connecting members can connect adjacent polyhedroids by contacting at least one face of each of the adjacent polyhedroids. The connecting members can be made of the same material as the connected polyhedroids. The connecting members can be made of a different material than the connected polyhedroids. The ring member can be formed as a single piece. The polyhedroids can be substantially hollow.

In specific implementations, each polyhedroid further comprises an upper face and a lower face. The upper face can be the uppermost surface of the polyhedroid and the lower face can be the lowermost surface of the polyhedroid. The upper and lower faces can be substantially flat.

In specific implementations, the ring element has an upper plane defined by the upper face of the polyhedroids, a lower plane defined by the lower faces of the polyhedroids, and a central plane defined by a mid-point between the upper and lower planes. The upper, lower, and central planes are substantially parallel, and at least a portion of each connecting member is located in the area of the central plane.

In specific implementations, the polyhedroids further comprise at least one adjacent upper face and lower face. The at least one adjacent upper face shares an edge with the upper face of the polyhedroid and the at least one adjacent lower face shares an edge with the lower face of the polyhedroid. The upper face or the at least one adjacent upper face form an opening in the polyhedroid, and the lower face or the at least one adjacent lower face form an opening in the polyhedroid. The openings are configured to receive a mortar element for connecting two ring elements together.

In another embodiment, a ring element comprises a plurality of icosahedroids and a plurality of connection members. Each icosahedroid has a generally icosahedral shape with edges, faces, and vertices. The connecting members connect each icosahedroid to two adjacent icosahedroids so that the plurality of icosahedroids form a closed ring shape. Each icosahedroid has an upper triangular face and a lower triangular face, with each of the upper and lower triangular faces having three edges.

In specific implementations, the icosahedroids can be spaced apart from one another. Each edge of the upper and lower triangular faces can form an edge of an adjacent triangular face. Each of the adjacent triangular faces can have three edges and an opening within the area defined by the three edges.

In specific implementations, the ring element can comprise six icosahedroids. In specific implementations, the connecting member can comprise a first end having a triangular base corresponding to one of the faces on a first icosahedroid and a second end comprising a triangular base corresponding to one of the faces on a second icosahedroid. The face corresponding to the triangular base of the second end can be a face other than the face that is on the second icosahedroid and which is closest to the face corresponding to that of the first icosahedroid.

In specific implementations, the connecting members can be made of the same or a different material than the connected icosahedroids. In specific implementations, the ring member can be made of high density polyethylene and/or formed as a single piece. In specific implementations, the icosahedroids can be substantially hollow. In specific implementations, the upper triangular face and lower triangular faces can be oppositely oriented. In specific implementations, the icoashedroids can be regular icosahedrals.

In specific implementations, the ring element can have an upper plane defined by the upper triangular faces of the icosahedroids, a lower plane defined by the lower triangular faces of the icosahedroids, and a central plane defined by a midpoint between the upper and lower planes. The upper, lower, and central planes can be substantially parallel, and at least a portion of each connecting member can be located in the area of the central plane.

In specific implementations, the connecting members can extend from one icosahedroid to another at an angle that is less than about 22 degrees from the central plane. More specifically, the angle can vary from about 0 to about 22 degrees. In specific implementations, the connecting members can connect adjacent icosahedroids by contacting at least one vertex of each of the adjacent icosahedroids. In specific implementations, the connecting members can connect adjacent icosahedroids by contacting at least one face of each of the adjacent icosahedroids.

In another embodiment, a mortar element comprises a first triangular element and a second triangular element. The first and second triangular elements have three edges. First extending members extending upwardly from the three edges of the first triangular element and second extending members extending downwardly from the three edges of the second triangular element.

In specific implementations, the first triangular element is oriented oppositely from the second triangular element. In specific implementations, the mortar element further comprises at least three second triangular elements and the three second triangular elements are oriented in the same general direction. In specific implementations, there are three second triangular elements and one first triangular element.

In specific implementations, the first and second triangular elements can be generally disposed in the same plane. In specific implementations, each of the first extending members can extend generally away from other first extending members associated with the same first triangular element at an angle that is less than about 22 degrees from the plane of the first and second triangular elements, and each of the second extending members can extend generally away from other second extending members associated with the same second triangular element at an angle that is less than about 22 degrees from the plane of the first and second triangular elements. More specifically, the angle can vary from about 0 to about 22 degrees.

In specific implementations, each of the extending members further comprises a protrusion. The protrusion can extend generally inwards towards the protrusions of extending members that extend from the same central triangular element. In specific implementations, an upper surface of each of the first extending members can define an open triangular area and a lower surface of each of the second extending members can define an open triangular area.

In specific implementations, the protrusions can be shaped to be received in a recess of an associated building element. In specific implementations, the protrusions can be generally pyramid shaped. In specific implementations, the protrusions can be generally in the shape of an oblique triangular pyramid.

In another embodiment, a kit comprises at least one ring element and at least one mortar element. The ring element comprises a plurality of interconnected icosahedroids, with each icosahedroid having a generally icosahedral shape with edges, faces, and vertices. The mortar element comprises a first triangular element and a first extending member extending from the first triangular element. One or more faces of each icosahedroid form an opening. The first extending member is configured to extend into the opening to connect the ring element with the mortar element.

In specific implementations, the kit comprises at least a first and second ring element, and the first ring element is capable of being coupled to a first side of the mortar element and the second ring element is capable of being coupled to a second side of the mortar element.

In specific implementations, each icosahedroid has an upper triangular face and a lower triangular face, with each of the upper and lower triangular faces having three edges. Each edge of the upper and lower triangular faces forms an edge of an adjacent triangular face, and the adjacent triangular faces each have three edges forming the opening into which the first extending member extends.

In specific implementations, the first and second triangular elements can be generally disposed in the same plane. In specific implementations, each of the first extending members can extend generally away from one another at an angle that is less than about 22 degrees from the plane of the first and second triangular elements, and each of the second extending members can extend generally away from one another at an angle that is less than about 22 degrees from the plane of the first and second triangular elements. More specifically, the angle can vary from about 0 to about 22 degrees.

In another embodiment, an array comprises a plurality of ring elements and a plurality of mortar elements. The plurality of mortar elements are connected to the plurality of ring elements to form at least two layers of ring elements. Each ring element comprises six icosahedroids interconnected to one another to form a substantially circular shape, with each icosahedroid having a generally icosahedral shape. Each mortar element has extending members that extend upwards and downwards from a central plane of the mortar element, and the icosahedroids have openings near an upper surface. The openings are configured to receive the extending members of the mortar elements to connect the mortar elements to the ring elements.

In specific implementations, the array is omni-extensible. In specific implementations, an existing array can be increased in size by connecting additional ring elements and mortar elements without other modifications to the existing array. In specific implementations, the ring elements are arranged in multiple, generally parallel layers. In specific implementations, each ring element is offset from a ring element that is above or below it in an adjacent parallel layer. In specific implementations, the plurality of mortar elements comprises spanning mortar elements, with the spanning mortar elements being configured to connect two ring elements in a single parallel layer. In specific implementations, the spanning mortar element also connects the two ring elements to another ring element that is above or below it in the adjacent parallel layer.

In specific implementations, the upper surface of each icosahedroid forms an upper triangular face and the lower surface of each icosahedroid forms a lower triangular face, with each of the upper and lower triangular faces having three edges. Each edge of the upper and lower triangular faces forms an edge of an adjacent triangular face, and the adjacent triangular faces each have three edges that define the opening for receiving the extending members.

In specific implementations, the mortar element further comprises a first triangular element and a second triangular element connected to the first triangular. The first and second triangular elements have three edges. The extending members extend from the edges of the first and second triangular elements. In specific implementations, the extending members associated with each triangular element extend generally away from one another at an angle that is less than about 22 degrees to the central plane. More specifically, the angle can vary from about 0 to about 22 degrees.

The foregoing and other objects, features, and advantages of the invention will become more apparent from the following detailed description, which proceeds with reference to the accompanying figures.

DETAILED DESCRIPTION

Figure 2:
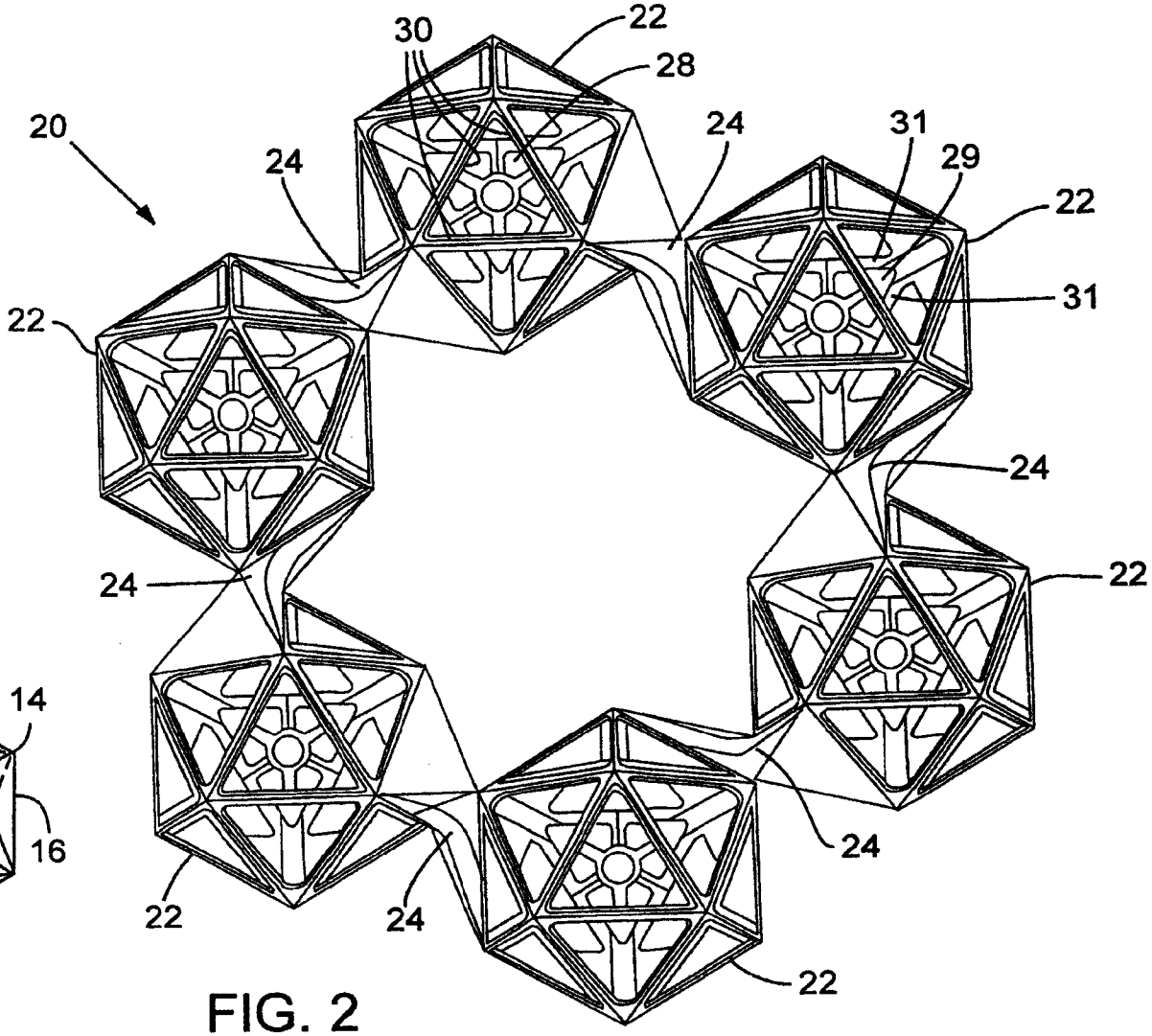
FIG. 2 is a top plan view of a ring element comprising six polyhedroids connected together, with each polyhedroid having a generally icosahedral shape.

Described below are various embodiments of symmetrical polyhedroid arrays. The terms polyhedron and polyhedral refer to three-dimensional geometric shapes that have flat faces and straight edges. Polyhedroids, as the term is used herein, are symmetrical elements that have generally polyhedral shapes that fall into the category of either regular Platonic polyhedrons or Archimedean (or semi-regular) polyhedrons. Polyhedroids can have an open form (e.g., wire frame), a closed form, or a combination of an open and closed form. The polyhedroids may include recesses or other openings in one or more surfaces.

Regular Platonic polyhedrons are the most symmetrical polyhedrons with each face making up congruent regular polygons. The five regular Platonic polyhedrons include the tetrahedron (4 equilateral triangular faces, 6 edges, and 4 vertices), the cube (6 square faces, 12 edges, and 8 vertices), octahedron (eight equilateral triangular faces, 12 edges, and six vertices), the dodecahedron (12 regular pentagon faces, 30 edges, and 20 vertices), and the icosahedron (20 equilateral triangle faces, 30 edges, and 12 vertices).

The Archimedean polyhedrons are also highly symmetric, although generally somewhat less symmetrical than the Platonic polyhedrons. The Archimedean polyhedrons are semi-regular convex polyhedrons that are composed of two or more types of regular polygons meeting in identical vertices. The Archimedean polyhedrons include the truncated tetrahedron, cuboctahedron, truncated cube, truncated octahedron, rhombicuboctahedron, truncated cuboctahedron, snub cube, icosidodecahedron, truncated icosahedron, rhombicosidodecahedron, truncated dodecahedron, truncated icosidodecahedron, and snub dodecahedron.

Even more desirably, the polyhedron that is selected from the Platonic polyhedrons and Archimedean polyhedrons has five-fold symmetry. The polyhedrons with 5-fold symmetry include the icosahedron, dodecahedron, truncated icosahedron, icosidodecahedron, truncated icosidodecahedron, snub dodecahedron, rhombicosidodecahedron, and truncated dodecahedron.

The symmetry of a polyhedron is a result of the geometric shape of the polyhedron. Rotational symmetry is determined by rotating or repositioning a polyhedron about an axis so that it appears not to have been moved. We can determine the n-fold symmetry of a geometric object by identifying the number of identical positions it can achieve when rotated about an axis. The regular icosahedron, for example, has axes of 2-fold, 3-fold, and 5-fold rotational symmetry. A 5-fold axis passes through the centers of each pair of opposite vertices, a 3-fold axis passes through the centers of each pair of opposite faces, and a 2-fold axis passes through the midpoints of each pair of opposite edges. Thus, there are six 5-fold axes, ten 3-fold axes, and fifteen 2-fold axes. By forming an array of polyhedroids selected from the polyhedra that have 5-fold symmetry, each polyhedroid can fit and join the array in the structured ordered required without requiring significant alignment efforts.

The polyhedroid arrays described herein comprise a plurality of polyhedroids, with each polyhedroid in the array having the same general geometric shape. For example, if a polyhedroid in an array (or ring element) is generally icosahedral shaped, the other polyhedroids in the array (or ring element) are desirably also generally icosahedral shaped. Accordingly, although the shape of polyhedroids in an array may vary somewhat due to structural requirements or preferences (such as requirements relating to positioning and attachment of connection members, discussed in more detail below), polyhedroids in an array (or ring element) are desirably of the same general shape.

The plurality of polyhedroids can form an array or lattice that has at least two layers of polyhedroids. Each layer of polyhedroids is interconnected to at least one adjacent layer via one or more mortar elements. The terms mortar and mortar elements, as they are used herein, refer to an inter-layer connecting element that is capable of connecting adjacent layers to one another.

The two types of elements, polyhedroid elements and the mortar elements generally are configured to serve different structural purposes. The polyhedroid elements are generally predominantly in compression as they are the primary load bearing elements. On the other hand, the mortar elements, which assist in holding the polyhedroids in the proper position in the array or lattice, are generally predominantly in tension. Accordingly, the polyhedroid elements are desirably selected so that they function well in compression and the mortar elements are desirably selected so that they function well in tension. Of course, polyhedroid elements can be in tension and mortar elements can be in compression in an array structure, and both elements are desirably configured to perform well in both compression and tension.

The polyhedroids can be solid, hollow, or at least partially hollow. If the polyhedroids are solid or substantially structures, they can function well in compression in a variety of shapes, with the primary consideration being the selection of the material(s) forming the polyhedroid.

The polyhedroids are desirably constructed so that their strength to weight ratio is high and, therefore, it is preferable that the polyhedroids are substantially hollow. As used herein, the term substantially hollow when used to refer to a polyhedroid means that the filled (or occupied) space of a polyhedroid is at least less than half the volume of the interior of the polyhedroid. In addition, the polyhedroids are desirably spaced apart from one another by connecting members, forming an "open" array configuration. In view of the substantially hollow configuration of individual polyhedroids and the open array configuration, the strength to weight ratio of the array is inherently high regardless of the selection of the material for the components of the array. This open structural configuration can reduce the weight of the array, reduce the material requirements to construct the array, and reduce transportation costs associated with delivering the array to the location of its use.

If the polyhedroid is substantially hollow, it is desirable to select a shape that is inherently particularly strong so that the polyhedroid can withstand higher compression forces. Even more desirably, however, the selected Platonic and Archimedean polyhedral shape will include either external structures that have sides that form generally triangular members, internal structures that form generally triangular members, or both.

Triangles are structurally strong geometric shapes and, therefore, it is desirable that the polyhedroids are formed of or otherwise include triangular members. For example, under heavy loads of compression a square can begin to distort or show signs of failure; however, with the addition of a diagonal brace element, the square can effectively be transformed into two triangular shapes and the resulting structure is much more resistant to deformation. Thus, the Platonic and Archimedean shapes that comprise triangular elements (such as the icosahedron, which comprises 20 triangular faces) can exhibit significant structural strength based on their external structures. Additionally, triangular elements can be included in the interior of a building element or polyhedroid to buttress the strength of the polyhedroid. In other words, if a polyhedroid is configured to be substantially hollow, the polyhedroid can be constructed with internal triangular elements to provide additional strength to the structure of the substantially hollow polyhedroid.

Figure 1:
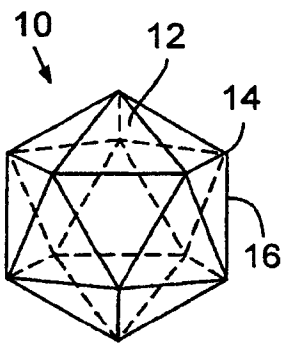
FIG. 1 is a vector representation of a regular icosahedral element having twenty faces forming equilateral triangles.

An example of a polyhedroid array that is formed by a plurality of repeating elements is disclosed with reference to FIGS. 1-8. FIG. 1 shows an exemplary regular polyhedroid, i.e., an icosahedron 10. Icosahedron 10 is a polygon comprising twenty faces. Icosahedron 10 is a "regular" icosahedron because each of its twenty faces is an equilateral triangle. Icosahedron 10 comprises faces 12, vertices 14, and edges 16. Icosahedron 10 has twenty faces 12, thirty edges 16 and twelve vertices 18. Five faces 12 meet at each of the vertices 14. As each face forms an equilateral triangle, all of the internal angles of each face are equal and the edges are all the same length.

FIG. 2 shows a top plan view of a ring element 20. Ring element 20 comprises six polyhedroids 22. Polyhedroids 22 have a generally icosahedral shape with edges, faces, and vertices. Polyhedroids 22 can also be considered icosahedroids, which is defined herein as a structure that is generally icosahedral shaped.

Although each polyhedroid 22 is generally icosahedral shaped, polyhedroids 22 are not identical in shape and structure. Connecting members 24 connect polyhedroids 22 together into a generally circular, closed ring shape. The faces 26 on each polyhedroid can be open (e.g., having an opening between the edges that form the face) or closed (e.g., a solid face without any opening).

The polyhedroids are desirably arranged in a closed ring element 20 so that an upper surface of each polyhedroid is in the same general plane (i.e., the upper plane) as the upper surfaces of each of the other polyhedroids. Desirably, six polyhedroids form the closed ring element. The closed ring element may additionally include a seventh polyhedroid inside the ring element at the center. As discussed in more detail below, this additional polyhedroid is desirably omitted to reduce the weight of close ring element 20.

The upper surface of each polyhedroids can be defined by an upper triangular face 28, which is, in turn, defined by upper edges 30. Similarly, a lower surface of each polyhedroid is in the same general plane (i.e., the lower plane) as the lower surfaces of each of the other polyhedroids. The lower surface of each polyhedroid can be defined by a lower triangular face 29 and the lower triangular face is defined by lower edges 31. In FIG. 2, the lower triangular face bound by lower edges 31 is shown with a partially open face. As discussed in more detail below, the lower triangular face can be fully open like that of the upper triangular face 28.

Figure 3:
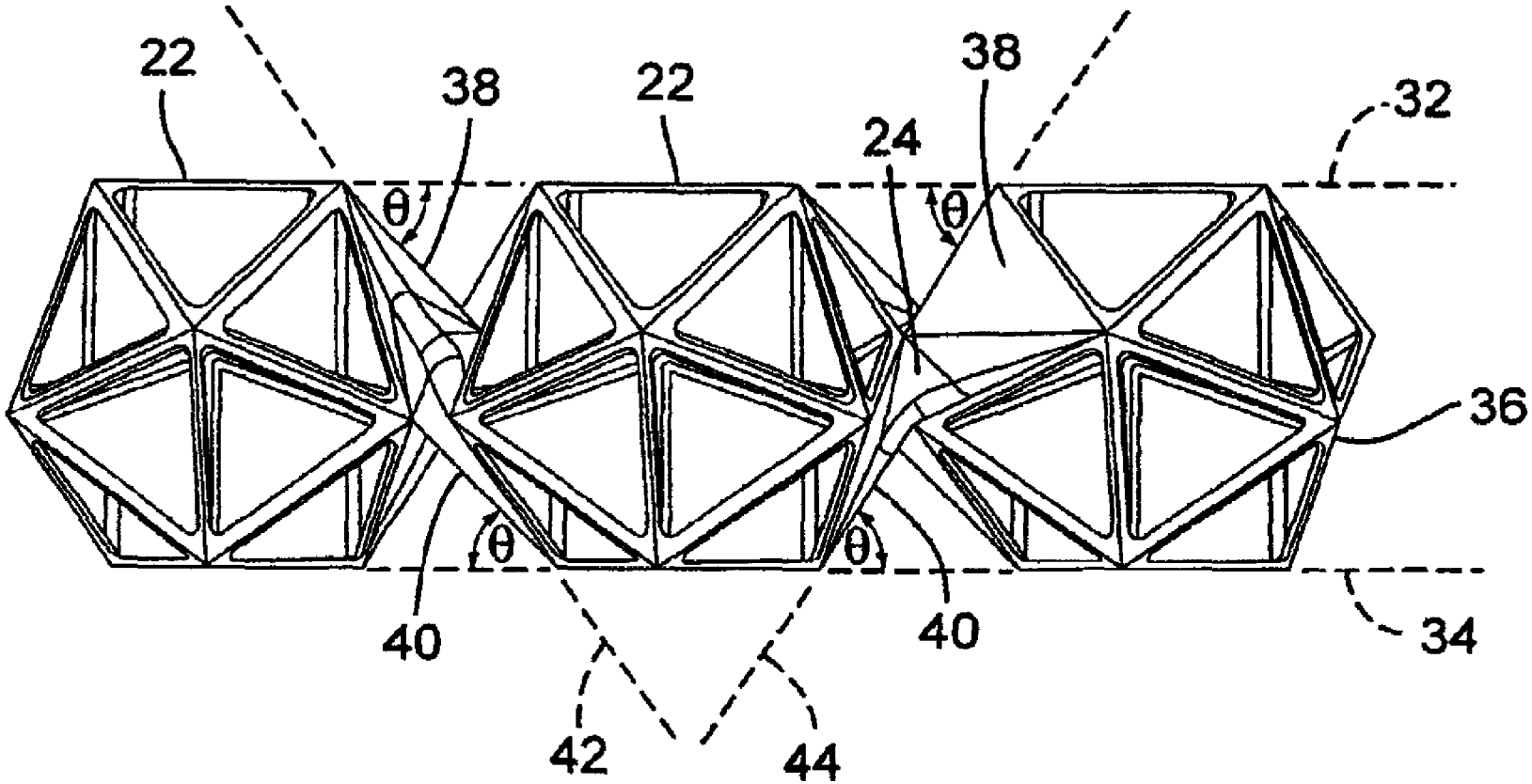
FIG. 3 is a side elevation view of the ring element of FIG. 2.

FIG. 3 shows a side elevation view of ring element 20. The upper plane 32 and the lower plane 34 are depicted by dashed lines and are substantially parallel to one another. As shown in FIG. 3, because the upper and the lower surfaces are defined by edges that form a triangle in the upper and lower planes, respectively, ring element 20 can rest flat, in a stable manner, on its upper or lower surfaces. A central plane 36 is defined by a mid-point between the upper and lower planes, with central plane 36 being parallel to each of the upper and lower planes. Connecting members 24 can have at least a portion that is located in the area of central plane 36. For example, as shown in FIG. 3, connecting member 24 can span from a position where it contacts a face or vertex that is above the central plane (upper portion 38) to a position where it contacts a face or vertex that is below the central plane (lower portion 40). By spanning across central plane 36 in this manner, there is a portion of connecting member 24 that passes through and is located in the area of central plane 36.

As shown in FIG. 3, connecting member 24 can be configured so the upper portion 38 contacts at least one face and/or vertex of a first polyhedroid and the lower portion contacts at least one face and/or vertex of a second polyhedroid. The resulting connecting member 24 can be formed in a direction that is generally defined by connecting line 42, 44. Connecting lines 42, 44 desirably form an angle θ with the lower and upper planes that is about 22 degrees. The angle θ can vary, however. More specifically, the angle can vary from about 0 to about 22 degrees.

Figure 4:
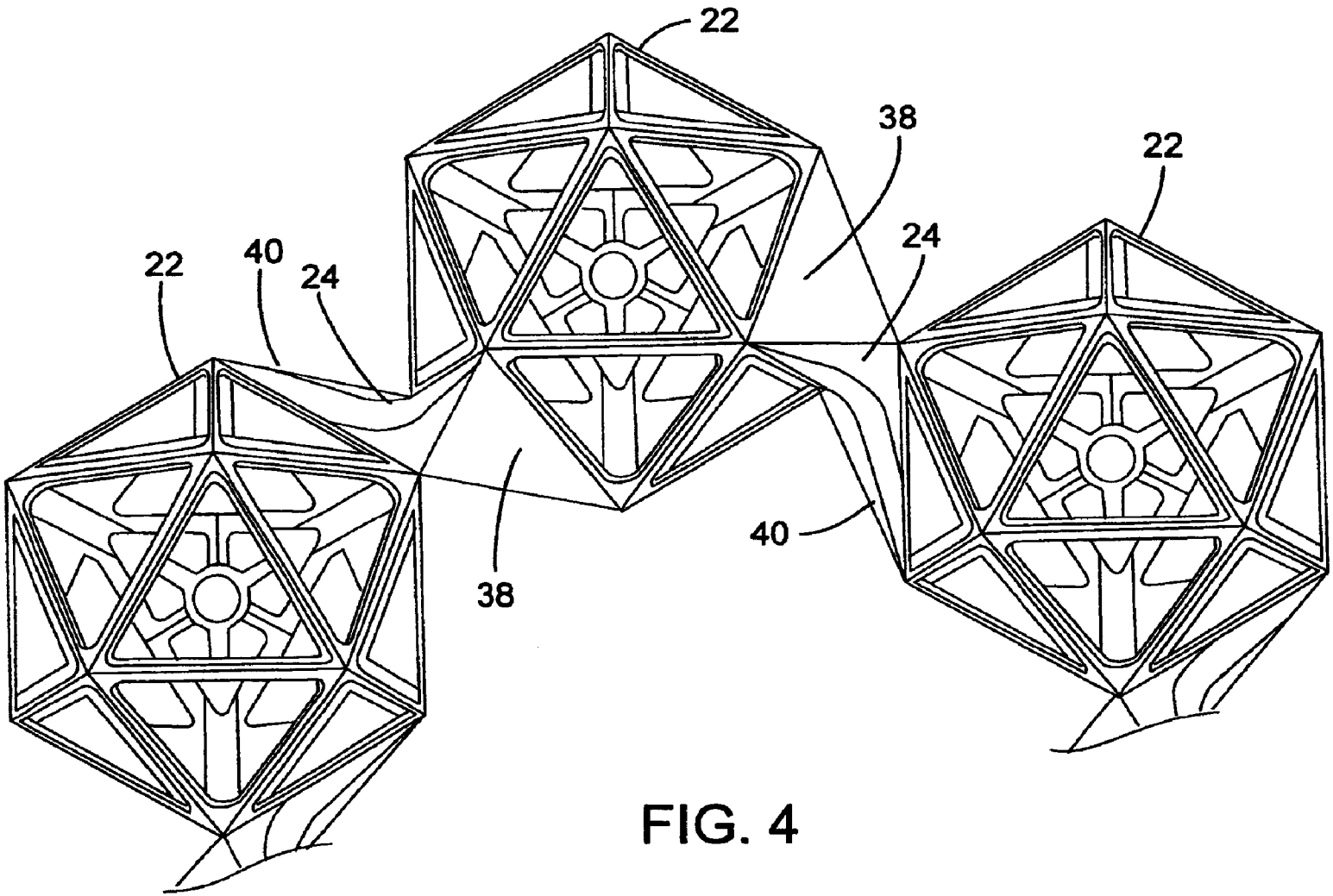
FIG. 4 is a top plan view showing an enlarged section of the ring element of FIG. 2.

FIG. 4 shows an enlarged view of connecting member 24. A polyhedroid 22 is joined to two adjacent polyhedroids 22 via connecting members 24. Each polyhedroid can be connected to an upper or lower portion of the connecting member. A polyhedroid can, as shown in FIG. 4, have an upper portion 38 as the point of connection on both sides. If a single polyhedroid is connected above the central plane by upper portions 38, then it is preferable that the adjacent polyhedroid be connected to its adjacent polyhedroids with lower portions 40 on each side of the polyhedroid. In this manner, polyhedroids that are connected to form the ring shape will alternate between polyhedroids that are connected with upper portions 38 and polyhedroids that are connected with lower portions 40.

As discussed in more detail below, ring element can be formed of a variety of materials, including, for example, high density polyethylene (HDPE), glasses, metals, woods, or other composite materials. Connecting members 24 can be formed of the same material as the polyhedroids or connecting members 24 can be formed of a different material. Desirably, connecting members are formed integrally with the polyhedroids to improve the structural integrity of the connection. Alternatively, however, connecting members can also be separately attached to the polyhedroids by any known attachment methods, including, for example, mechanical fasteners.

Connecting members 24 have two ends and, in the embodiment of FIG. 4, a first end is at an area of the upper portion 38 and a second end is at an area of the lower portion 40. The first end can have a triangular base that corresponds to the face that is located at or near the area of the upper portion. Similarly, the second end can have a triangular base that corresponds to the face that is at or near the area of the lower portion. In addition, as shown in FIG. 4, the face corresponding to the triangular base of one end of connecting member 24 can be a face other than the face that is closest to the face corresponding to the triangular base of the other end of connecting member 24. By forming a connecting member in this manner (i.e., across a central plane and between two non-neighboring faces), the structural integrity of the connection between the polyhedroids can be improved.

Figure 5:
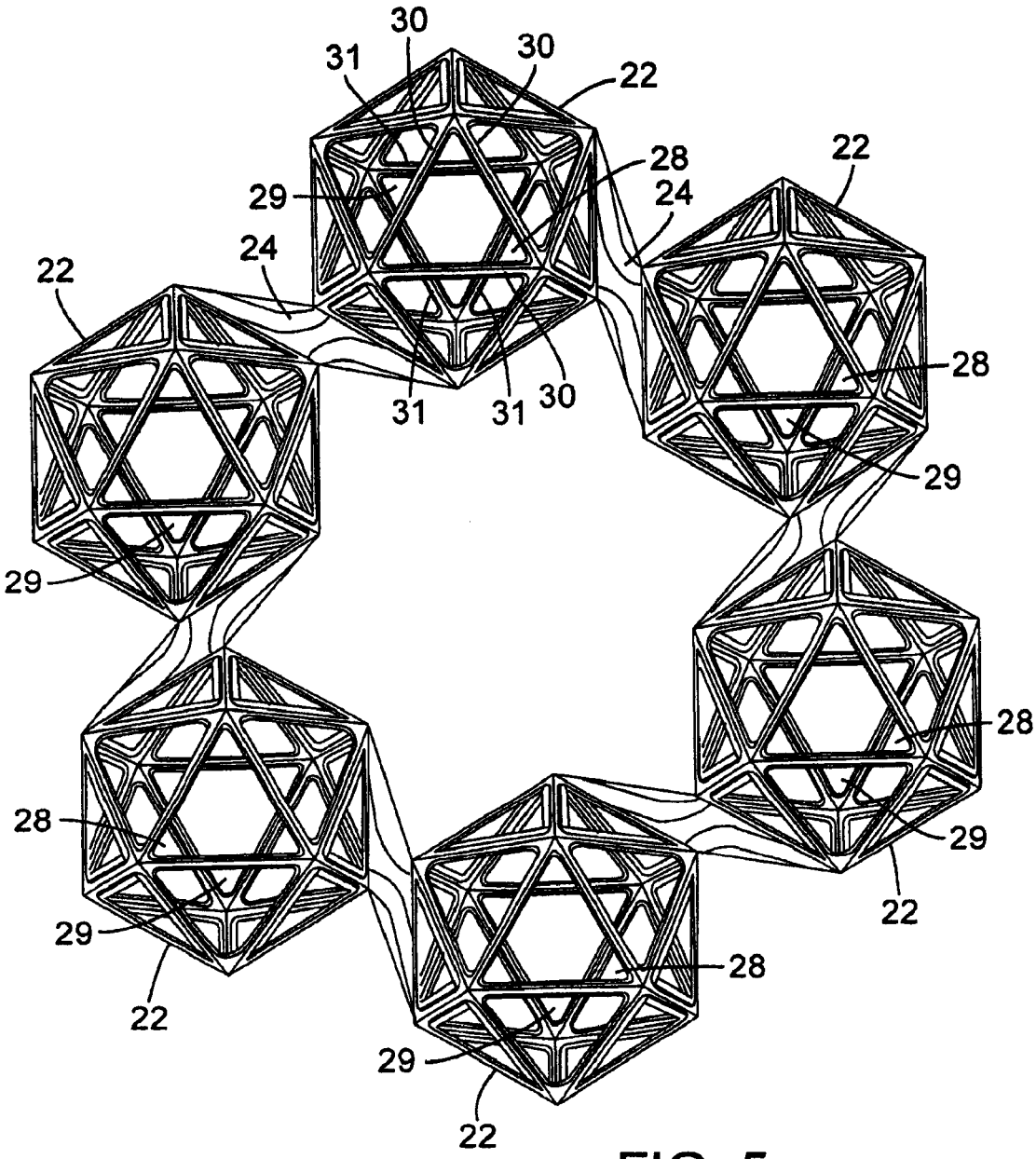
FIG. 5 is a top view of another ring element comprising six polyhedroids connected together.

FIG. 5 shows another embodiment of ring element 20. In this embodiment, both the upper triangular face 28 and the lower triangular face 29 are open. That is, edges 30 of the upper triangular face and edges 31 of the lower triangular face define openings into the body of the polyhedroid 22. As shown in FIG. 5, each of the upper triangular faces 28 is preferably oriented in the same general direction as the other upper triangular faces. Similarly, each of the lower triangular faces 29 is preferably oriented in the same general direction as the other lower triangular faces. In addition, the upper triangular faces 28 are also preferably oriented oppositely to the lower triangular faces 29.

Figure 6A:
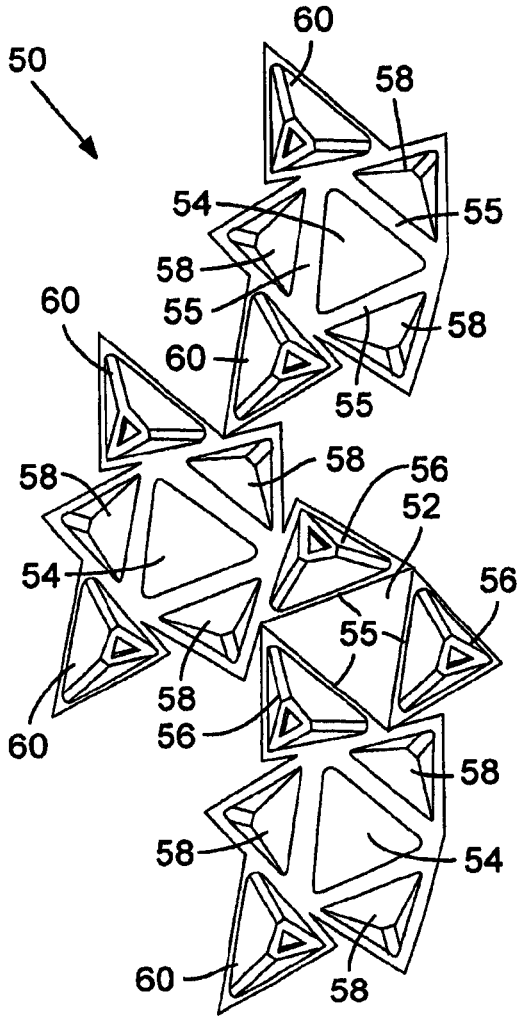
FIG. 6A is a top view of a mortar element.
Figure 6B:
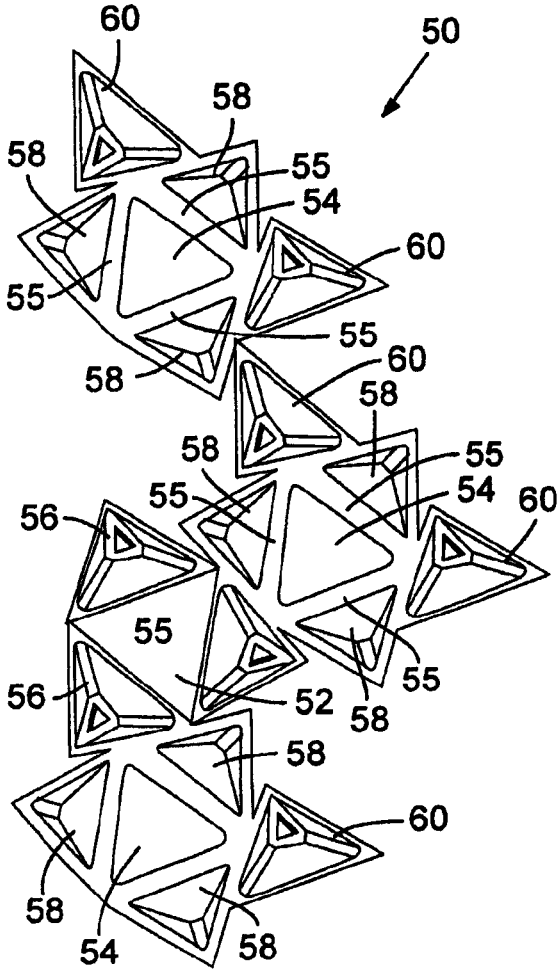
FIG. 6B is a top view of another mortar element.

FIGS. 6A and 6B show embodiments of mortar elements 50. Mortar elements 50 are configured to connect two or more ring elements to one another. Mortar elements can be configured to mate or connect with faces or openings in the polyhedroids to secure the mortar element to a ring element.

Mortar elements 50 comprise a first triangular element 52 and a second triangular element 54. As shown in FIGS. 6A and 6B, each of second triangular elements 54 is oriented in the same general direction as each of the other second triangular elements 54. Because both the upper and lower surfaces of polyhedroid 22 are triangular in shape, triangular elements 54 and 56 (which have the same shape) are configured to face and contact the triangular upper and lower surfaces of the polyhedroid when the ring and mortar elements are connected.

In addition, second triangular elements 54 are oriented oppositely to the first triangular elements 52. In FIGS. 6A and 6B, mortar elements 50 are shown comprising three second triangular elements and one first triangular element. This can arrangement, however, can vary. If more than one first triangular element is included on a mortar element, the plurality of first triangular elements are desirably all oriented in the same general direction.

Each of the first triangular and second triangular elements has three edges 55. First extending members 56 extend upward from each of the three edges of first triangular element 52. Second extending members 58 extend downward from each of the three edges of the second triangular element 54. First and second triangular elements are preferably disposed in the same general plane, and the direction of the extension of the first and second extending members (i.e., upwards or downwards) is relative to that plane.

First extending members 56 can extend upwardly from first triangular elements 52 at an angle of approximately 22 degrees from the common plane of the first and second triangular elements. Similarly, second extending members 58 can extend downwardly from second triangular elements 54 at an angle of approximately 22 degrees from the common plane of the first and second triangular elements. The angle of the extending members described above can vary from 22 degrees. More specifically, the angle can vary from about 0 to about 22 degrees.

In addition, as shown in FIGS. 6A and 6B, each of the first extending members extends generally away from the other first extending members associated with the same first triangular element, and each of the second extending members extends generally away from the other second extending members associated with the same second triangular element.

As shown in FIGS. 6A and 6B, the mortar element can further include extension members that are not associated with an edge of one of the first or second triangular elements. For example, third extension member 60 is shown extending upwardly from the common plane of the first and second triangular elements; however, third extension member 60 is does not extend from the edges of the first or second triangular elements. The number and position of third extension members can be varied. In addition, the third extension member can be configured to extend downward from the common plane of the first and second triangular elements. The shape of the first, second, and third extending members can be identical, with only the orientation and/or positioning of the members being different.

Figure 7A:
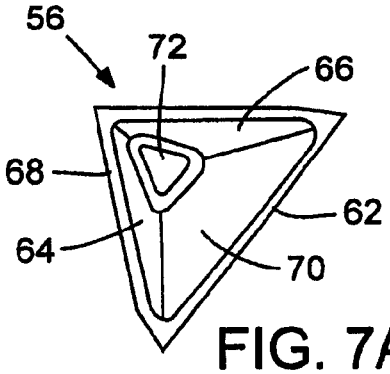
FIG. 7A is a top view of a first extending member of a mortar element.
Figure 7B:
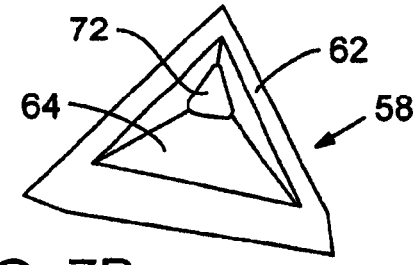
FIG. 7B is a top view of a second extending member of a mortar element.

FIGS. 7A and 7B show a first extending member 56 and a second extending member 58, respectively. The shape of the first and second extending members in FIGS. 7A and 7B is identical, with only the orientation of the two members being different. The first and second triangular members can comprise a triangular base portion 62 and a protrusion 64 that protrudes from the base portion 62. The protrusion can be substantially pyramid shaped. As shown in FIG. 7A, the protrusion 64 can be shaped as an oblique triangular pyramid having three pyramid sides 66, 68, 70 that are not equal in size. In addition, the pyramid shaped protrusion can be truncated so that there is an open triangular area 72 at the distal end of the protrusion. For the first extending members, the distal end is at an upper surface of the protrusion, and for the second extending members, the distal end is at a lower surface of the protrusion. Although the extending members extend generally away from other extending members extending from the same triangular element, the protrusions protrude generally back inwards towards the other protrusions of the other related extending members.

Figure 8A:
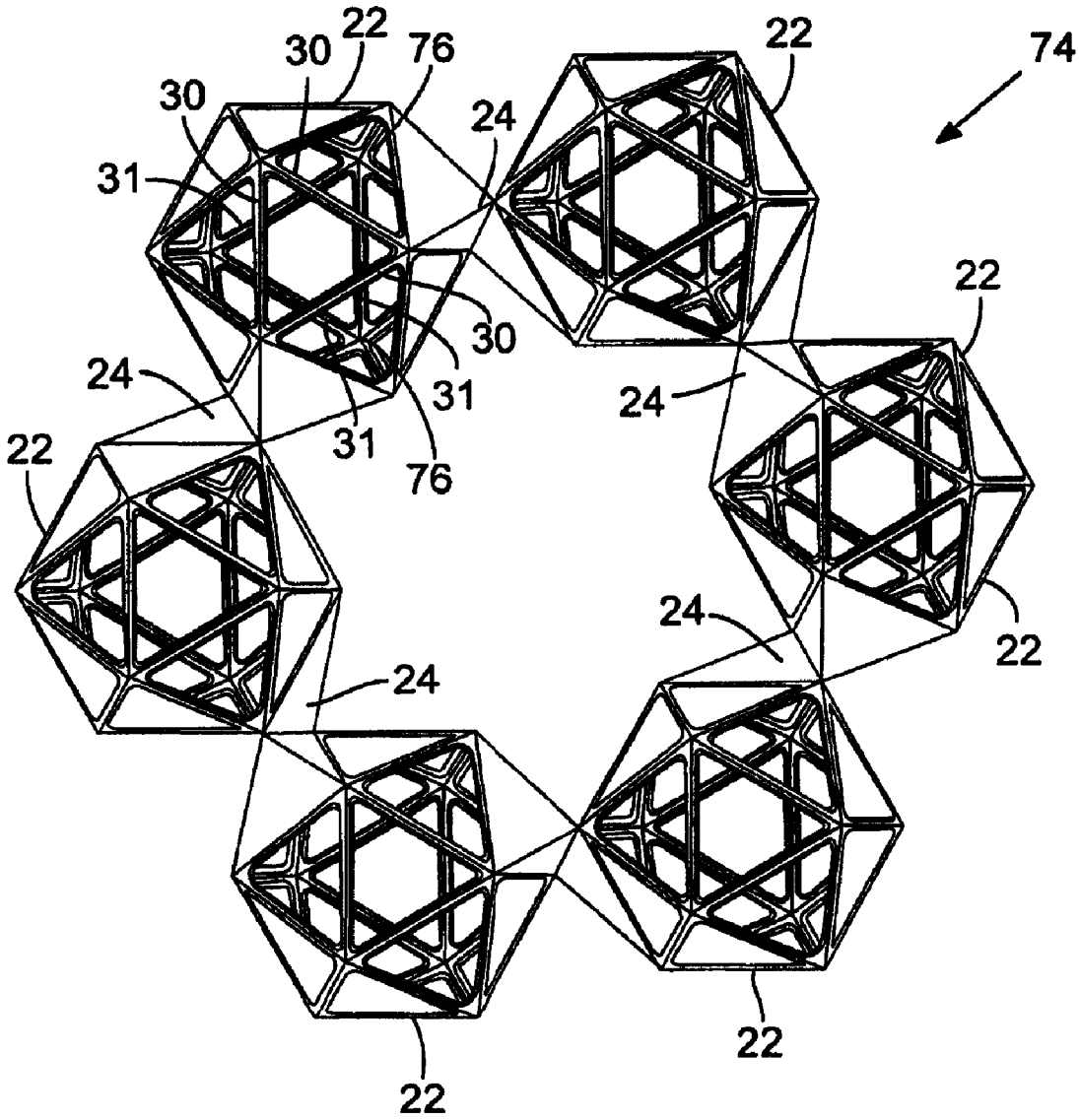
FIG. 8A is a top view of a ring element comprising six polyhedroids connected together.

FIGS. 8A-8E show a method for creating an array by connecting ring and mortar elements together. FIG. 8A shows a ring element 74. Ring element 74 comprises six polyhedroids 22. The polyhedroids 22 are spaced apart from one another and connected together by connecting members 24. The polyhedroids 22 are substantially hollow. Each of the polyhedroids 22 has an upper triangular face that is defined by upper edges 30 and a lower triangular face that is defined by lower edges 31. The upper and lower triangular faces are open, with each upper and lower triangular face forming an opening or recess. In addition, each edge of upper and lower triangular faces forms an edge of an adjacent triangular face 76. Adjacent triangular faces 76 are also open, thereby forming an opening or recess between the edges that form the adjacent triangular face.

Figure 8B:
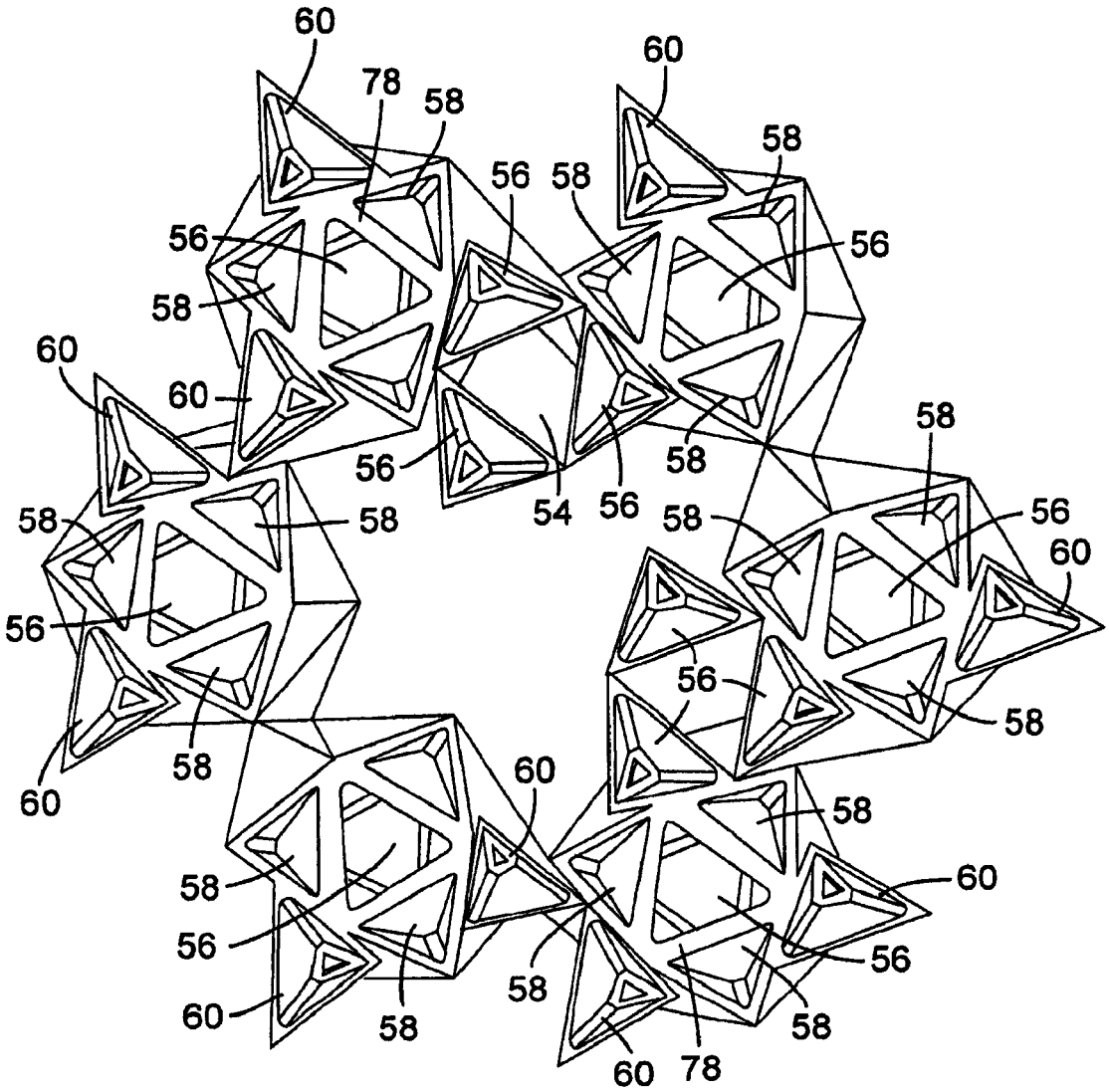
FIG. 8B is a top view of an array comprising a ring element and mortar elements.

FIG. 8B shows ring element 74 connected to two mortar elements 78. Although FIG. 8B shows two mortar elements 76 connected to a ring element, it should be understood that the mortar elements could be combined into one larger mortar element or separated into more than two mortar elements. Mortar elements 78 have first triangular elements 54 and second triangular elements 56. First triangular elements 54 have first extending members 56 that extend upward from the edges that define first triangular elements 54. Second triangular elements 56 have second extending members 58 that extend downward from the edges that define second triangular elements 56.

Figure 8C:
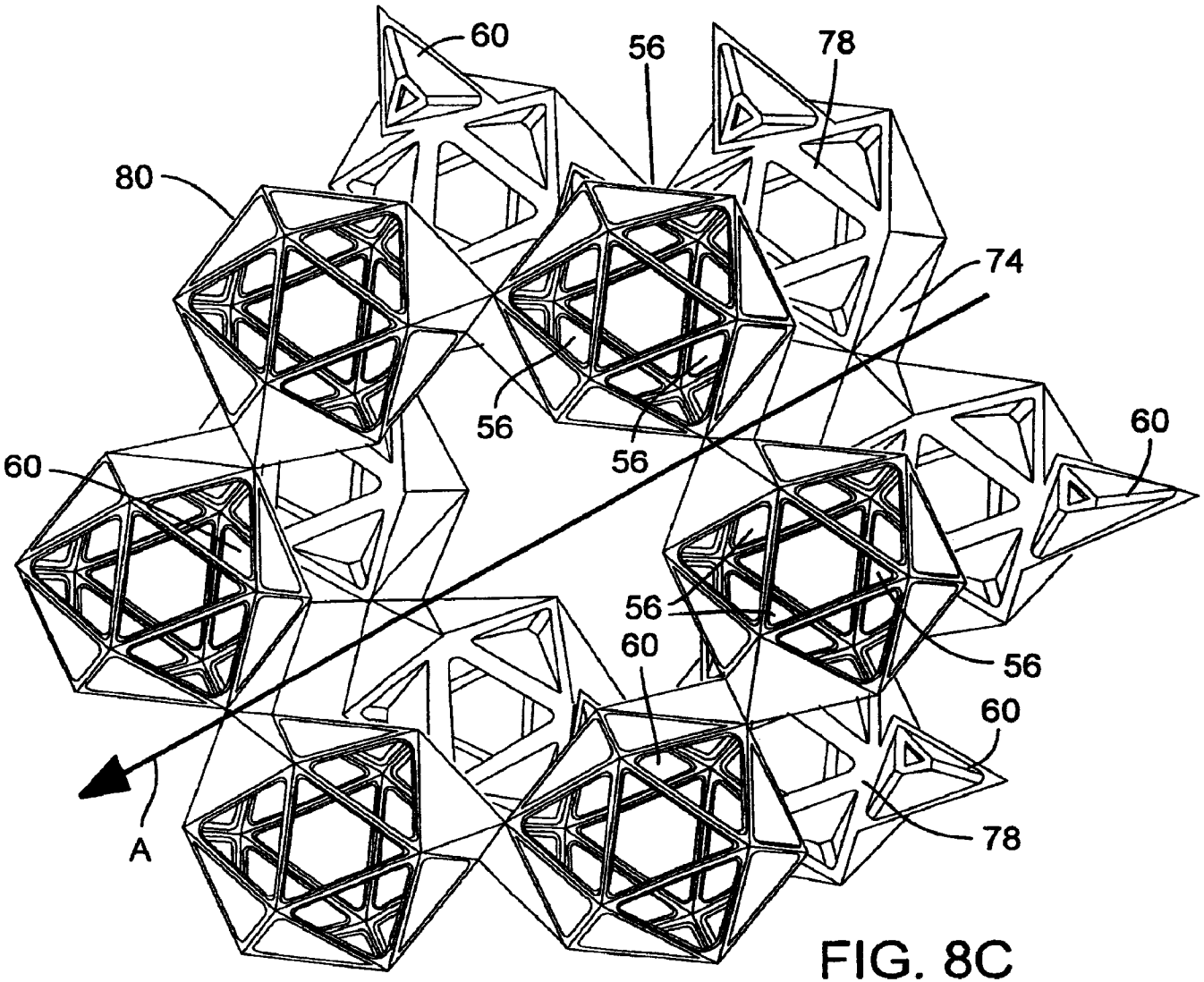
FIG. 8C is a top view of an array comprising two ring elements connected together with mortar elements.

The second extending members 58 extend into the opening or recess of the adjacent triangular faces 76 (shown in FIG. 8A) to connect the ring element 74 to the mortar element 78. The second extending members can be configured to form a snap-fit or press-fit connection with the opening or recess in the adjacent triangular faces. As shown in FIG. 8B, the first extending members 56 extend upward and, therefore, do not mate or connect with any element of ring element 74. Instead, at least some of first extending members 56 can be configured to accept a second ring element (as shown in FIG. 8C). Similarly, third extending members 60 extend upwardly from mortar element 78 and do not mate or connect with any element of ring element 74. At least some of the third extending members 60 can be configured to mate or connect with a second ring element (as shown in FIG. 8C).

FIG. 8C shows an array comprising a second ring element 80 connected to the first ring element 74 and the first mortar elements 78 shown in FIG. 8B. At least some of first extending members 56 and third extending members 60 engage openings in adjacent triangular faces on ring element 80. As shown in FIG. 8C, second ring element 80 is offset from first ring element 74 in the direction shown by arrow A.

Figure 8D:
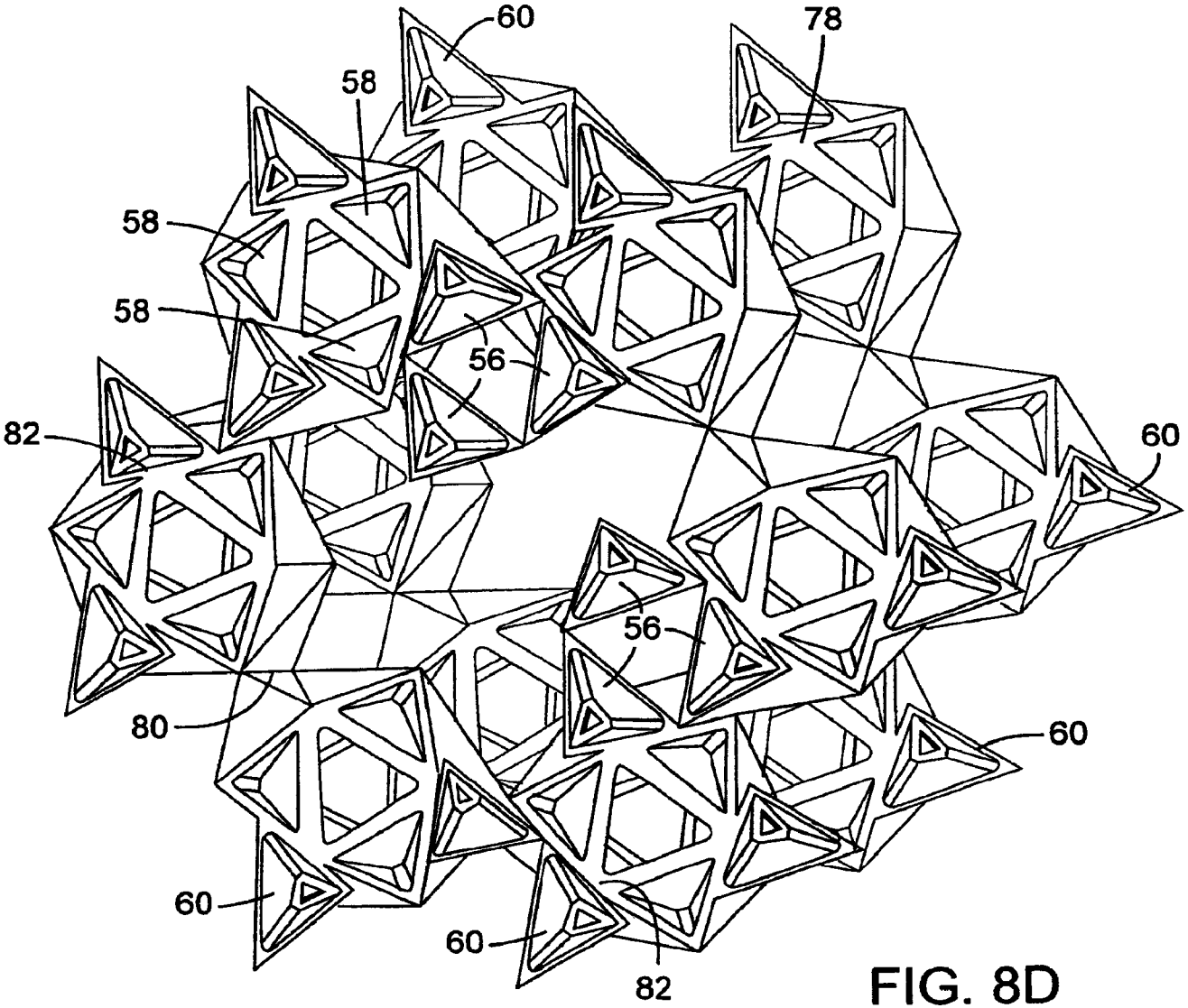
FIG. 8D is a top view of an array comprising two ring elements connected together with mortar elements and having an additional mortar layer for connection to a third ring element.

FIG. 8D shows the array of FIG. 8C with additional mortar elements 82 added to the second ring element 80. The additional mortar elements 82 engage the second ring element 80 in the same general manner that the first mortar elements 78 engaged the first ring element 74. Second extending members 58 extend downward into openings or recesses formed in adjacent triangular faces to connect the additional mortar elements 82 to second ring element 80. First extending members 56 and third extending members 60 extend upward to engage another ring member that can be placed, or stacked, onto the existing array.

Figure 8E:
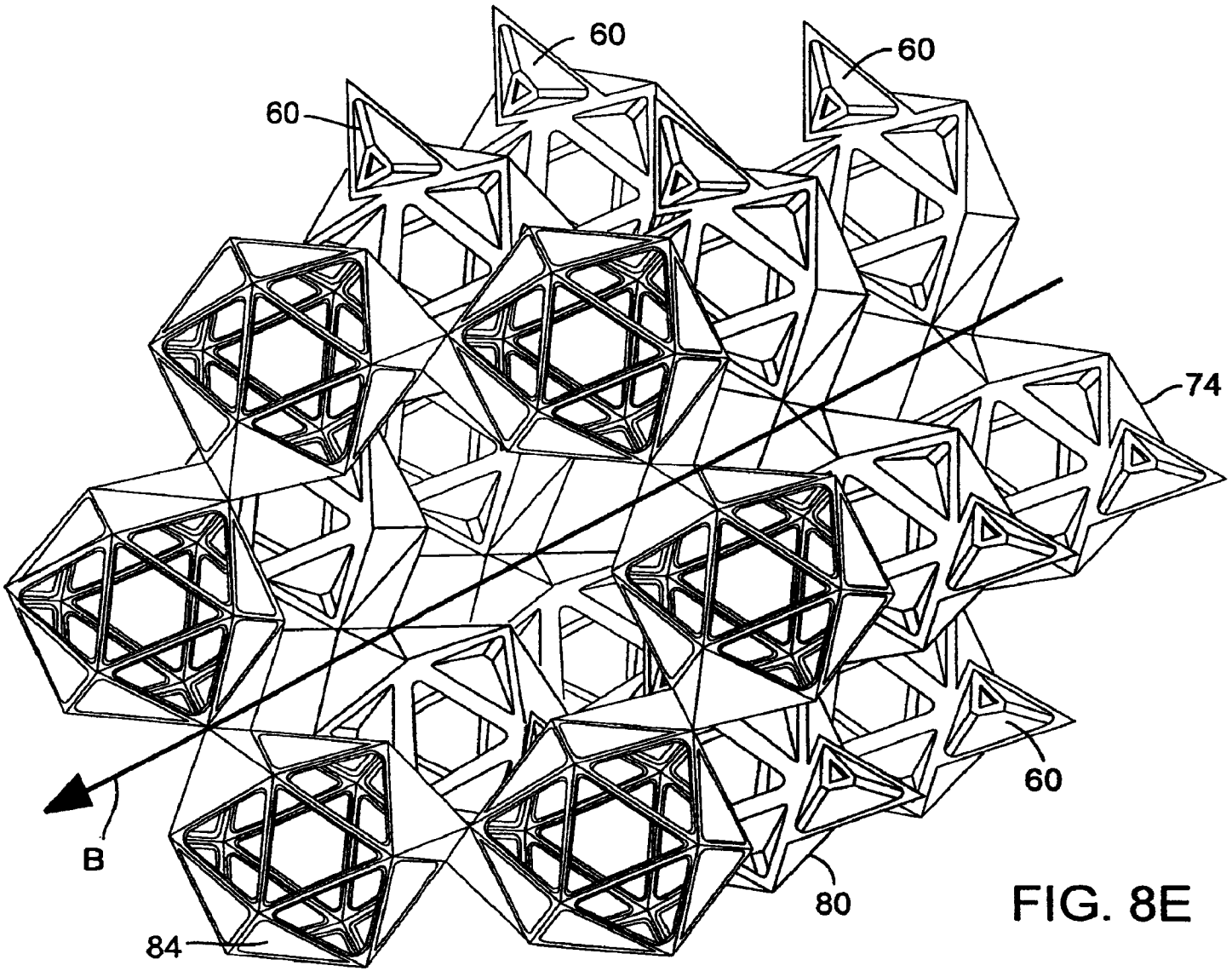
FIG. 8E is a top view of an array comprising three ring elements connected together with mortar elements.

FIG. 8E shows the array of FIG. 8D with a third ring element 84 added to the additional mortar elements 82. At least some of first extending members 56 and third extending members 60 of the additional mortar elements 82 engage openings in adjacent triangular faces on ring element 80. As shown in FIG. 8E, third ring element 84 is offset from first and second ring elements, 74 and 80, respectively, in the direction shown by arrow B.

As discussed above, ring elements can include an internal polyhedroid (i.e., a polyhedroid at the center of the six polyhedroids shown in FIG. 8A) or the internal polyhedroid can be omitted, such as is the case with the ring element of FIG. 8A. The omission of an internal polyhedroid can reduce the weight of the ring element, and, in turn, reduce the weight of an array formed of ring elements. Thus, it is possible to achieve a structural array with an even greater strength-to-weight ratio by eliminating or omitting the polyhedroid at the center of the ring element.

In a polyhedroid array, when using ring elements without an internal polyhedroid desirably there are at least three layers of ring elements. As shown in FIG. 8E, because of the offset nature of the stacked ring elements when viewing an array from above, the opening resulting from the omission of an internal polyhedroid is not covered until the addition of a third layer of ring elements. Thus, any reduction of structural integrity of the array resulting from the omission of the internal polyhedroid is largely eliminated after the addition of a third layer.

As discussed in more detail below, a polyhedroid array, such as that shown in FIGS. 8A-8E is omni-extensible, scalable, permeable, inherently stable, and ordered.

The polyhedroid array is omni-extensible, permitting expansion of the array in all directions—upward, downward, or outward—by adding additional mortar and/or ring elements to the array. Thus, the size of the array can be increased without requiring other modifications to the existing array. In addition, individual polyhedroids or polyhedroids that are otherwise not ring shaped can be connected to existing or added mortar elements to further expand the array or to "finish" off an array at its edges. That is, since the array build upon itself in an offset manner, as discussed above, it may be desirable to include finishing or border elements that fill or cover openings in the faces of exposed or exterior polyhedroids in the array. These finishing or border elements can include one or more polyhedroids. Alternatively, these finishing or border elements can comprise, for example, tiles that engage openings in the upper triangular face, lower triangular faces, or adjacent triangular faces. Polyhedroids can be formed with screw bosses or the like to accommodate such finishing elements.

In addition, the array is scalable and can be constructed in sizes ranging from very small to very large. Not only can the size of the array be increased by adding elements to the array (e.g., increasing the number of layers or the size of any layer), the size of the array elements themselves can be increased or decreased depending on the desired array size and application. Thus, the array can be constructed with polyhedroids ranging from the very small in size (e.g., measurable on a nano-scale) to the very large in size (e.g., measurable in meters or larger).

The permeability of the array results from the spaced apart configuration of the polyhedroids, and the configuration in which the mortar elements maintain the ring elements from one another. In addition, if the polyhedroids are substantially hollow, the polyhedroids themselves can be permeable. The resulting configuration is an array that is permeable, breathable, and self draining. The permeability of the array renders it suitable for numerous uses, including, for example, pavement, driveways, marine applications, filtering processes, or any other micro- or mega-scale application in which permeability is desirable. This open architecture also enables the positioning and retention of functional elements in the array, as discussed in more detail below.

The omni-extensible pattern of repeating polyhedroids is also inherently stable and ordered. The stability is a result of the strong structural strength of the individual polyhedroids and the array's ability to constrain the polyhedroids in each of the six-degrees of freedom (up, down, left, right, front, back) of the array.

The array is desirably formed in a "structured and ordered" manner. That is, that each ring element in the array is positioned, placed, or otherwise formed in a non-random manner. The ordered nature of the array makes it predictable in both its structural integrity as well as in its ability to receive additional functional elements as discussed below. Structurally, the ordered nature of the array means that it will perform more predictably than structures that are formed with non-ordered structures (such as concrete). In addition, the ordered nature of the array results in a failure resistance that limits structural damage to the location of the damage, preventing it from spreading to other areas of the array. Accordingly, deformation, damage, and/or other failures can be localized and controlled, thereby maintaining the integrity of the array as a whole.

Figure 9:
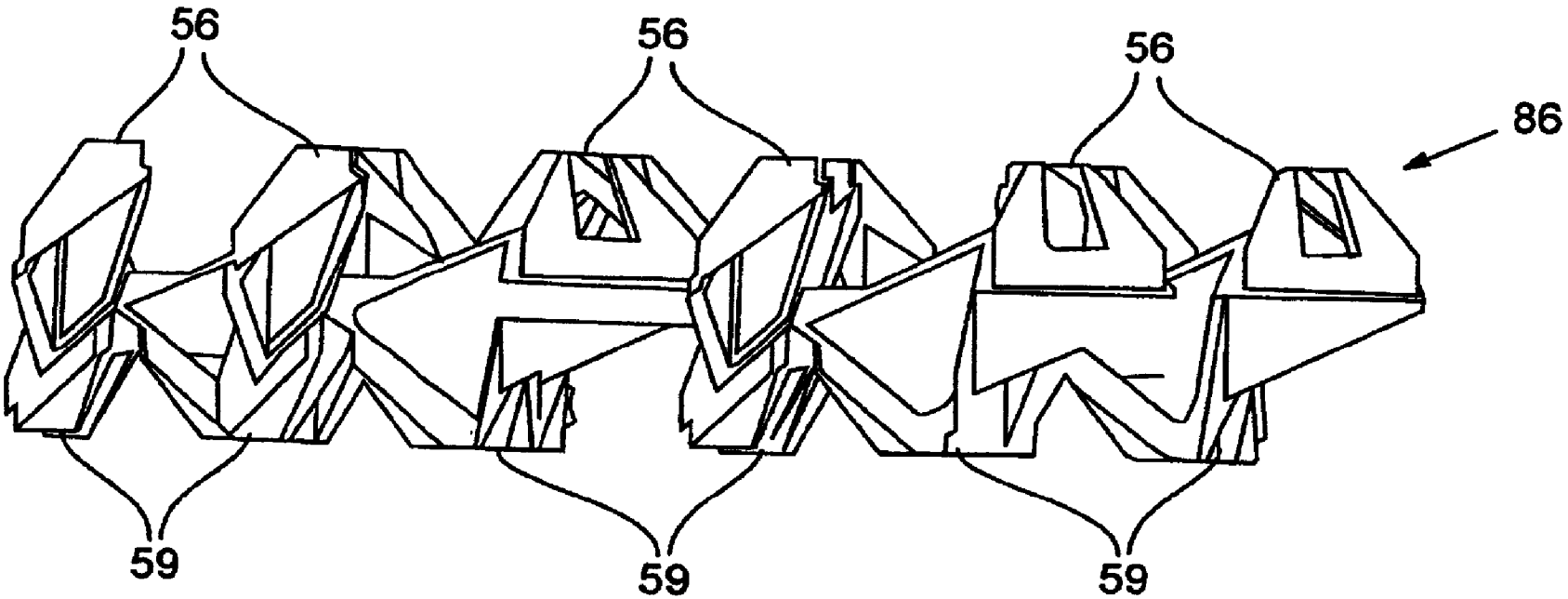
FIG. 9 is a side view of a mortar element.
Figure 10:
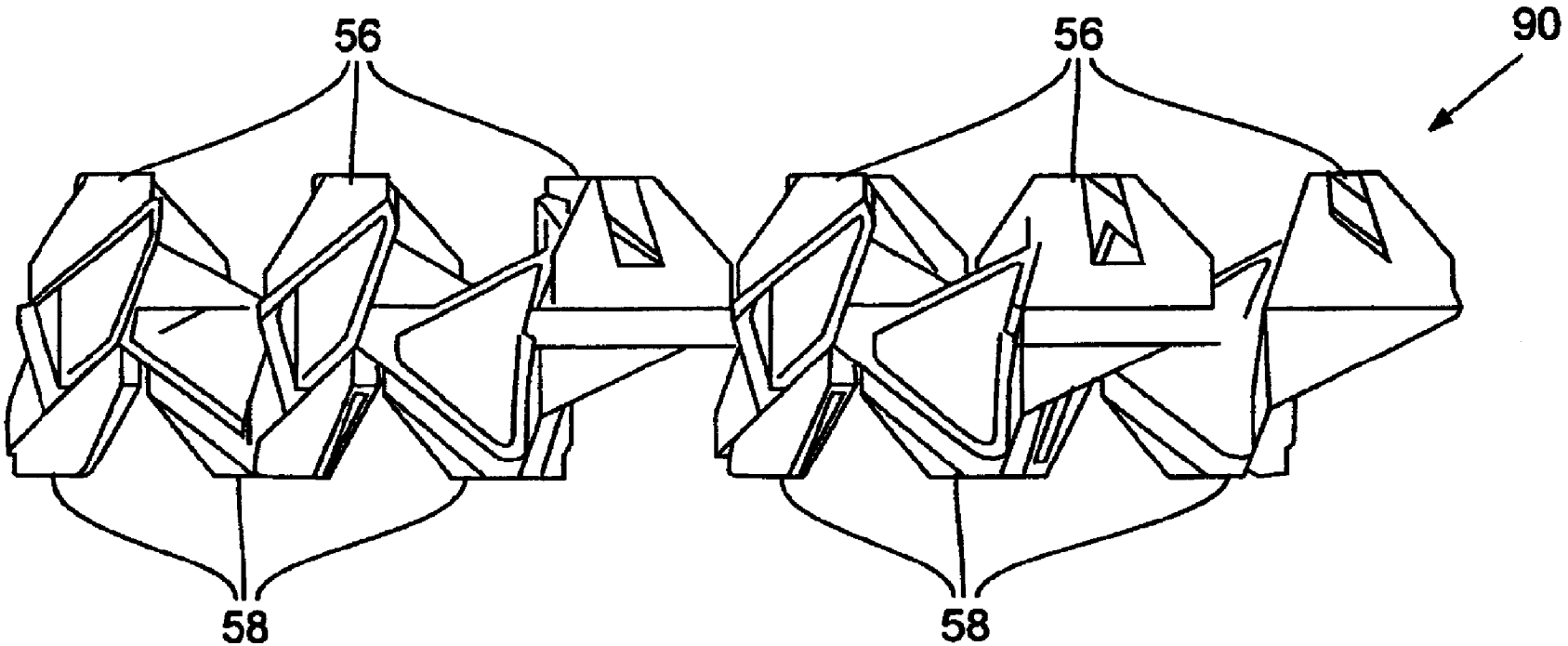
FIG. 10 is a side view of another mortar element.

As discussed above, the mortar elements can be formed in a variety of shapes. FIG. 9 is a side view of a mortar element 86 showing first extending members 56 and second extending members 58. FIG. 10 is a side view of another mortar element 90 showing first extending members 56 and second extending members 58.

FIGS. 11A and 11B, 12A and 12B, and 13A and 13B, show different views of a mortar element and ring element that can be connected to one another (along with other mortar elements and ring elements) to form an array.

Figure 11A:
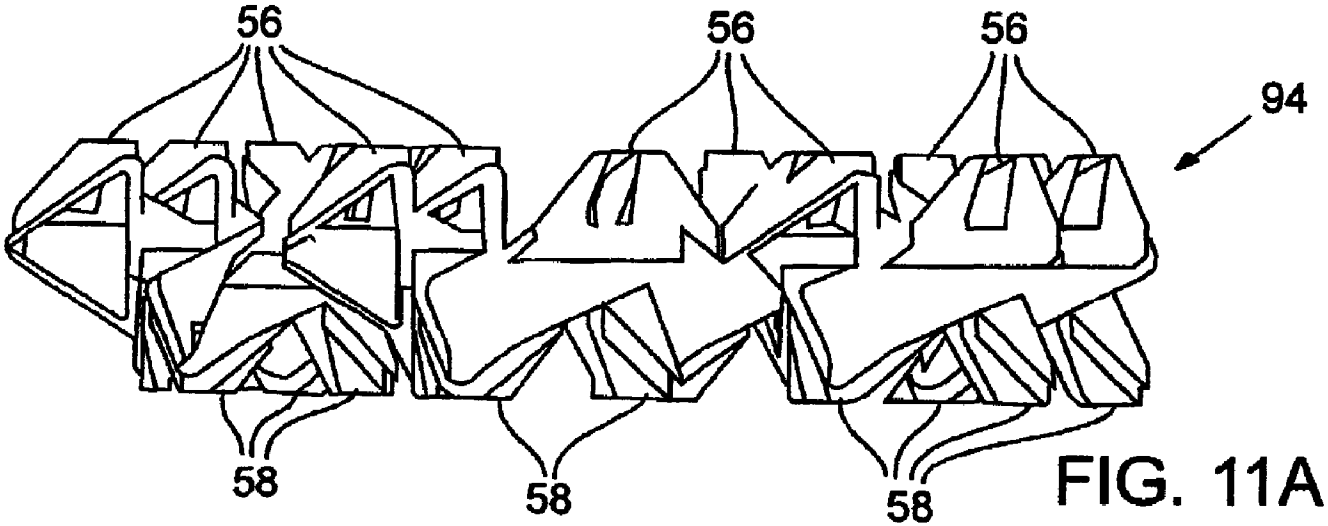
FIG. 11A is a side view of a mortar element.
Figure 12A:
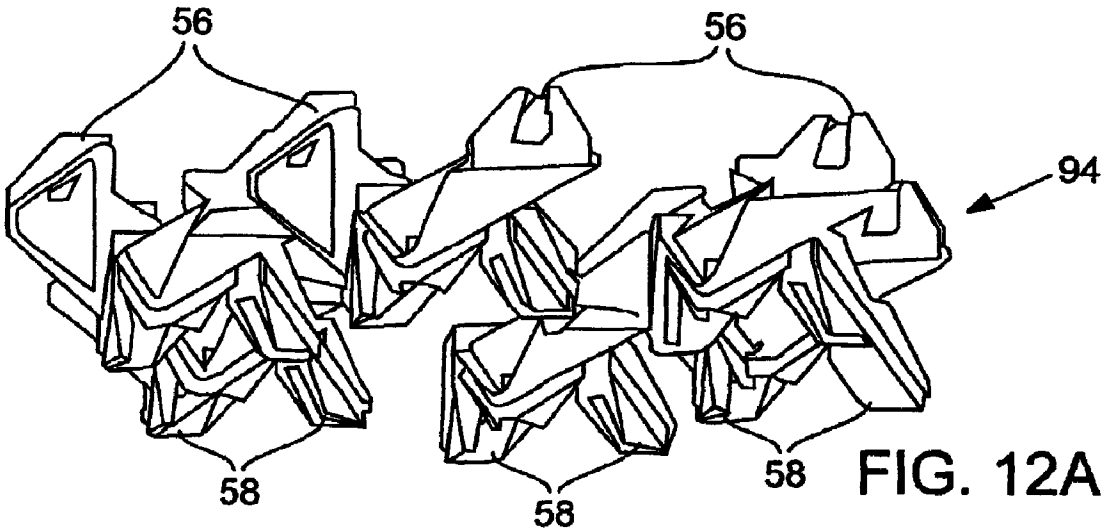
FIG. 12A is a lower perspective view of a mortar element.
Figure 13A:
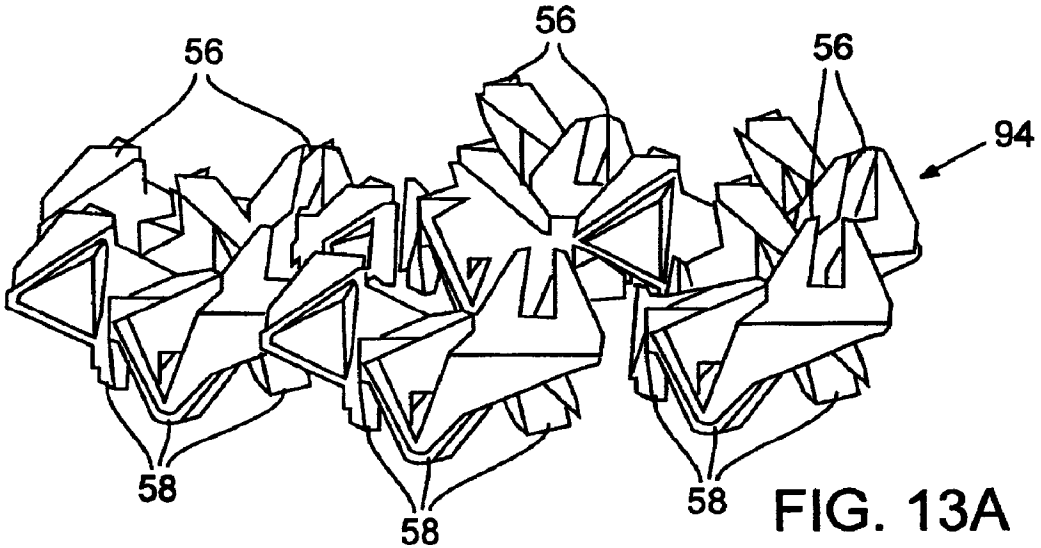
FIG. 13A is an upper perspective view of a mortar element.

FIGS. 11A is a side view of mortar element 94, FIG. 12A is a bottom perspective view of mortar element 94, and FIG. 13A is a top perspective view of mortar element 94. FIGS. 11A, 12A, and 13A illustrate first extending members 56 and second extending members 58.

Figure 11B:
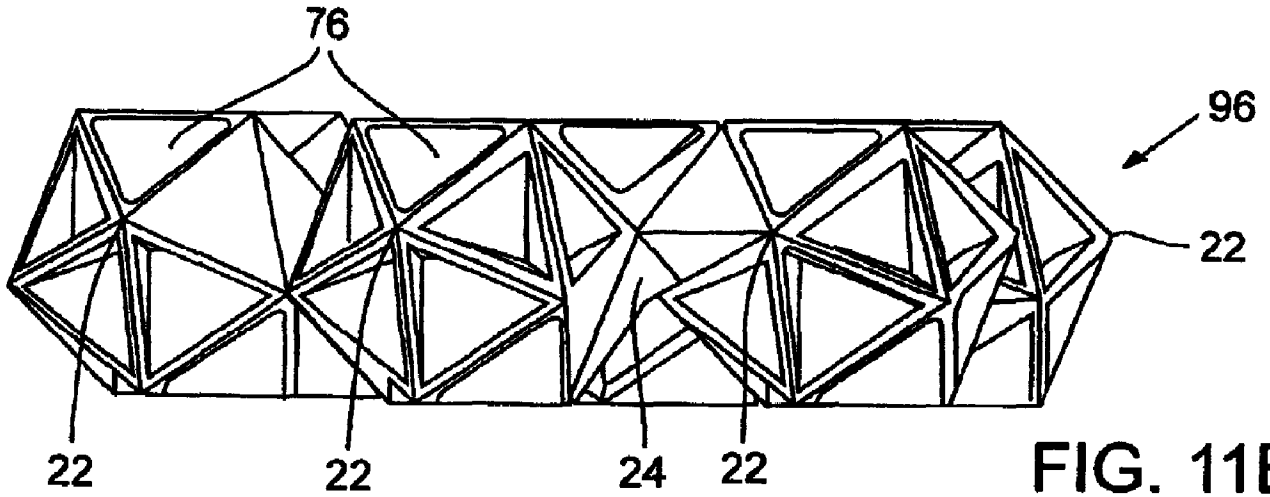
FIG. 11B is a side view of a ring element configured to connect to the mortar element of FIG. 11A.
Figure 12B:
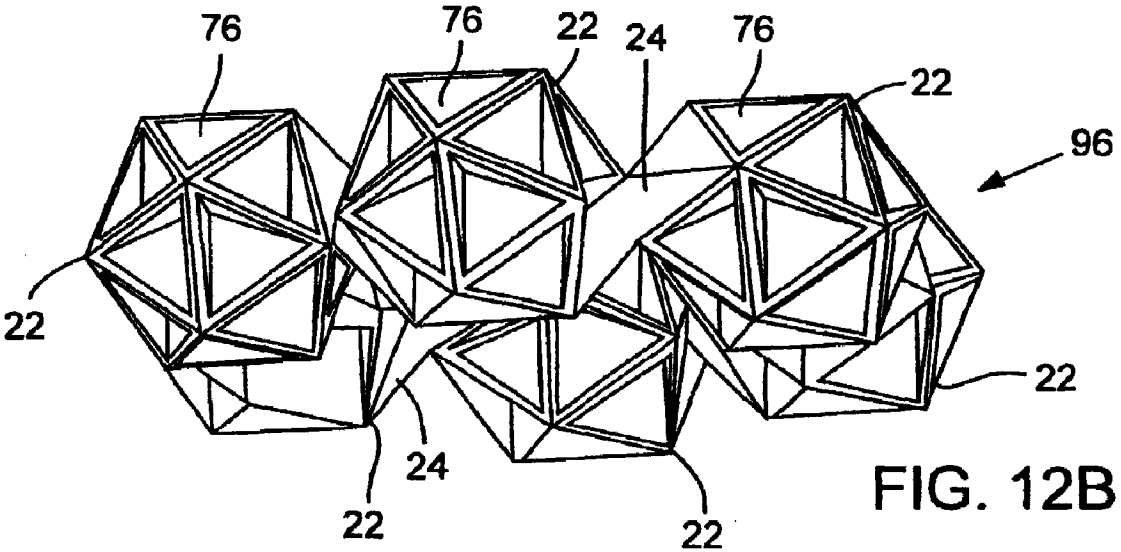
FIG. 12B is a lower perspective view of a ring element configured to connect to the mortar element of FIG. 12A.
Figure 13B:
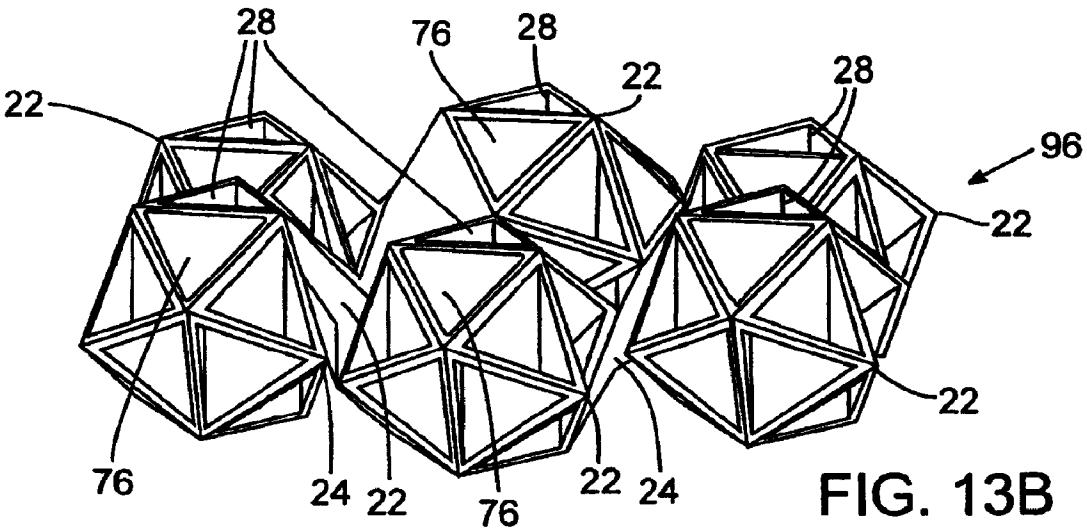
FIG. 13B is an upper perspective view of a ring element configured to connect to the mortar element of FIG. 13A.

FIGS. 11B is a side view of ring element 96, FIG. 12B is a bottom perspective view of ring element 96, and FIG. 13B is a top perspective view of ring element 96. FIGS. 11B, 12B, and 13B illustrate polyhedroids 22, connecting members 24, upper triangular faces 28, and adjacent triangular faces 76.

Figure 14:
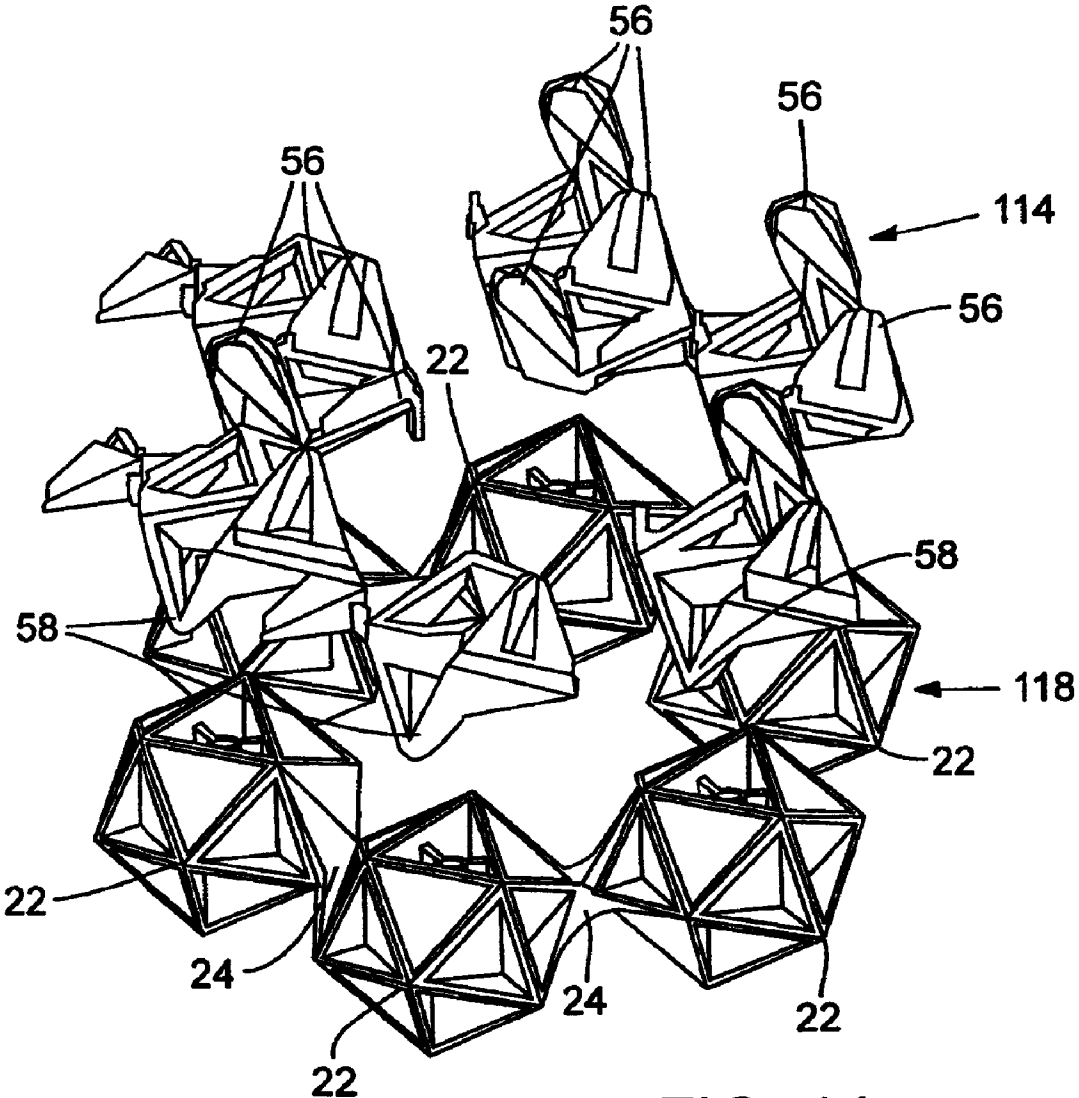
FIG. 14 is a perspective view of a mortar element connected to a ring element.

In addition to being used to "stack" ring elements (as shown, for example, in FIG. 8E), the mortar elements can be configured to span adjacent ring elements that are in the same plane or layer in order to connect those adjacent ring elements. In that regard, each of the mortar elements of FIGS. 6A and 6B can be used to "stack" ring elements or to "span" across adjacent ring elements, depending on where they are positioned on a ring element. FIG. 14 depicts a mortar element 114 functioning as a spanning mortar element with ring element 118. As seen in FIG. 14, when placed on top of ring element 118, mortar element 114 extends beyond ring element 118 so that another ring element can be connected to the mortar element in the same layer as ring element 118.

A mortar element can function as a spanning mortar element by simply engaging a mortar element on a first ring element so that at least one second extending member is not attached to the first ring element. A second ring element can be connected to the non-engaged second extending member to connect to the two ring elements so that they are positioned in the same layer or plane.

The mortar elements illustrated above are configured to engage with openings of a polyhedroid near an upper surface of the polyhedroid. In particular, the above described embodiments illustrate recesses or openings in faces that are adjacent to the upper and lower triangular faces (e.g., the adjacent triangular faces) and that engage or receive the extending members. Alternatively, the openings, recesses, or engagement areas for receiving or engaging extending members can be located in other locations as well. For example, as discussed above, the upper and lower triangular faces can be formed with openings and the mortar element can be configured to extend into or otherwise mate with those openings or some portion of those openings.

The mortar elements need not extend into openings or recesses in the polyhedroids. The mortar elements can be configured to connect adjacent layers of ring elements in a variety of manners. For example, the mortar element could be a "cup"-like fitted member that engages the surface of one or more polyhedroids, either by mating shapes or by a press-fit connection of some sort. The mortar could be welded members of a variety of shapes, formed either with the same material as the polyhedroids or with a different material. The mortar elements could also include spring members that either attach to polyhedroid elements or otherwise remain in position relative to the polyhedroid elements. In each of these cases, the mortar desirably has structure that extends upwards and structure that extends downwards from a central plane that is located at the horizontal mid-point between a vertical space defined by a top surface plane of a lower array layer and a bottom surface plane of an upper array layer.

The mortar can be a glue, plastic, or other liquid-to-solid, solidifying material (e.g., concrete). In such a case, the ring elements can be held in the ordered array position as desired by some other means (such as an external framework or form), and the solidifying material can be poured over the ordered array to secure the ring elements in their ordered position. The external framework or form can be later removed or it can simply be left in place within the array. Once the solidifying material hardens, the solidifying material forms a mortar element capable of securing the ring elements in the ordered array positions discussed throughout this application.

The polyhedroids can be positioned in a variety of configurations. For example, the polyhedroids can be configured so that they are arranged with an edge facing downward. Desirably, however, the polyhedroids are configured in the ring elements so that the polyhedroid has a first flat surface on a bottom and a second flat surface on the top of the polyhedroid. When configured in this manner, the ring element can be more easily constructed on a level surface. For example, FIGS. 3, 17, 23, and 27 show flat top and bottom surfaces of polyhedroids.

In addition, the polyhedroid is desirably selected so that the top and bottom of the polyhedroid has a smaller diameter or width than the middle of the polyhedroid. In this manner, it is possible to create a closely packed lattice of spaced apart polyhedroids. For example, if two cubes are spaced apart (but not far enough apart to fit another cube between the two cubes) a third cube cannot be stacked on the other two cubes so that a portion of the third cube is in the plane formed by the first two cubes. On the other hand, two polyhedroids that are spaced apart and icosahedral-shaped (see, e.g., FIG. 1) can permit a third icosahedral-shaped polyhedroid to stack on top of the first two in a manner where the third polyhedroid enters the plane of the first two polyhedroids in a more closely packed manner. This close packing of spaced apart polyhedroids can, in certain applications, provide greater stability and strength of an array. See, e.g., FIGS. 3, 17, 23, and 27 showing polyhedroids that can be close packed because they have larger dimensions at a central region than at upper and lower areas.

Figure 15:
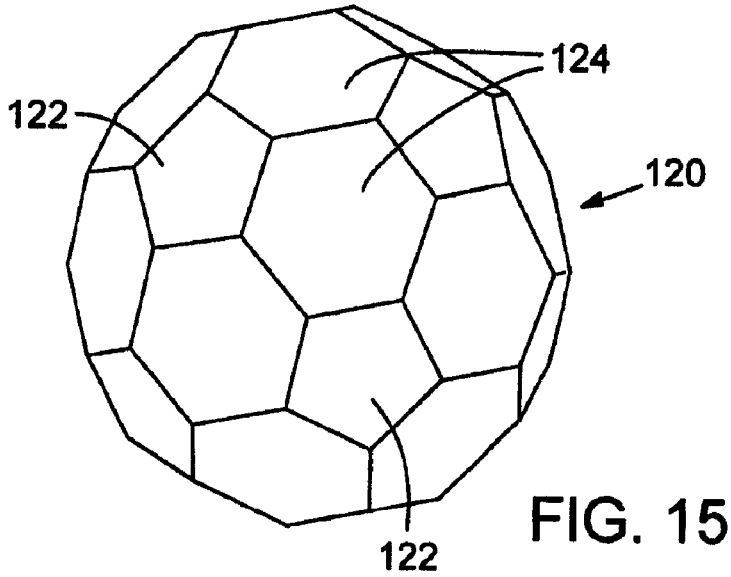
FIG. 15 is an illustration of a truncated icosahedron.

FIG. 15 shows a geometric representation of a truncated icosahedron 120, one of the Archimedean polyhedrons. The truncated icosahedron has 32 faces (twelve pentagons 122 and twenty hexagons 124), 90 edges, and 60 vertices.

Figure 16:
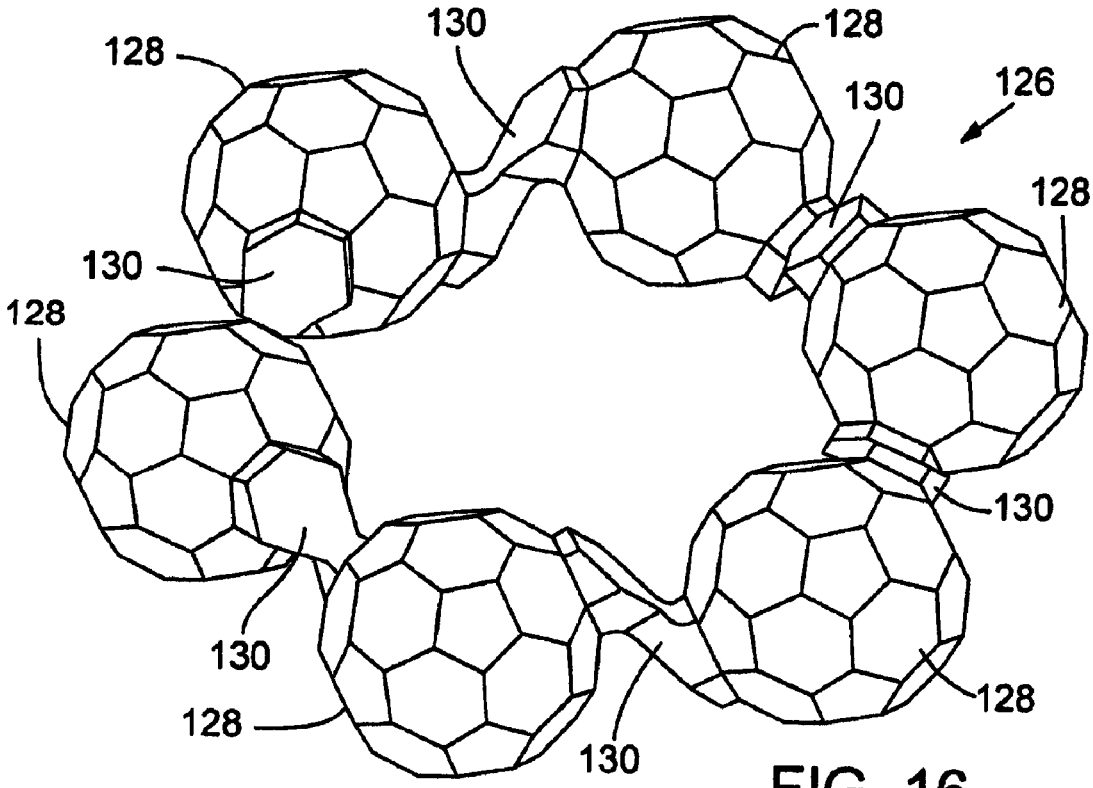
FIG. 16 is a perspective view of a ring element comprising six polyhedroids connected together, with each polyhedroid having a generally truncated icosahedral shape.
Figure 17:
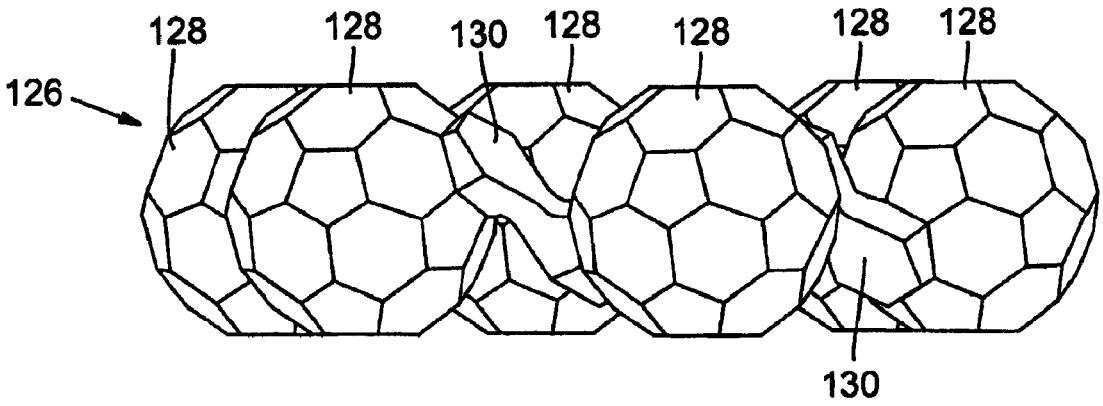
FIG. 17 is a side view of the ring element of FIG. 16.

FIGS. 16 and 17 show views of a ring element 126 formed of six polyhedroids 128, with each polyhedroid being generally shaped as a truncated icosahedron. Each of the six polyhedroids 128 is connected to two adjacent polyhedroids via connecting members 130. Ring element 126 does not have an internal polyhedroid; however, it could be constructed with another polyhedroid connected to one or more of the other polyhedroids and located in the center of the ring element.

Figure 18:
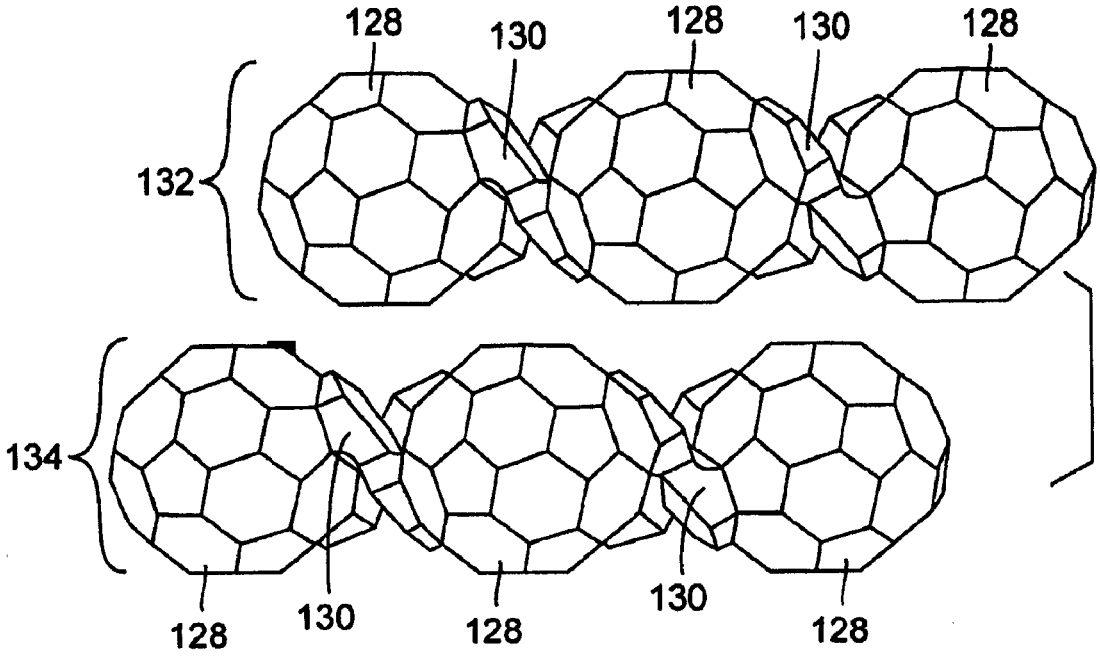
FIG. 18 is a side view of two ring elements stacked on top of one another to form an array with two layers of ring elements.
Figure 19:
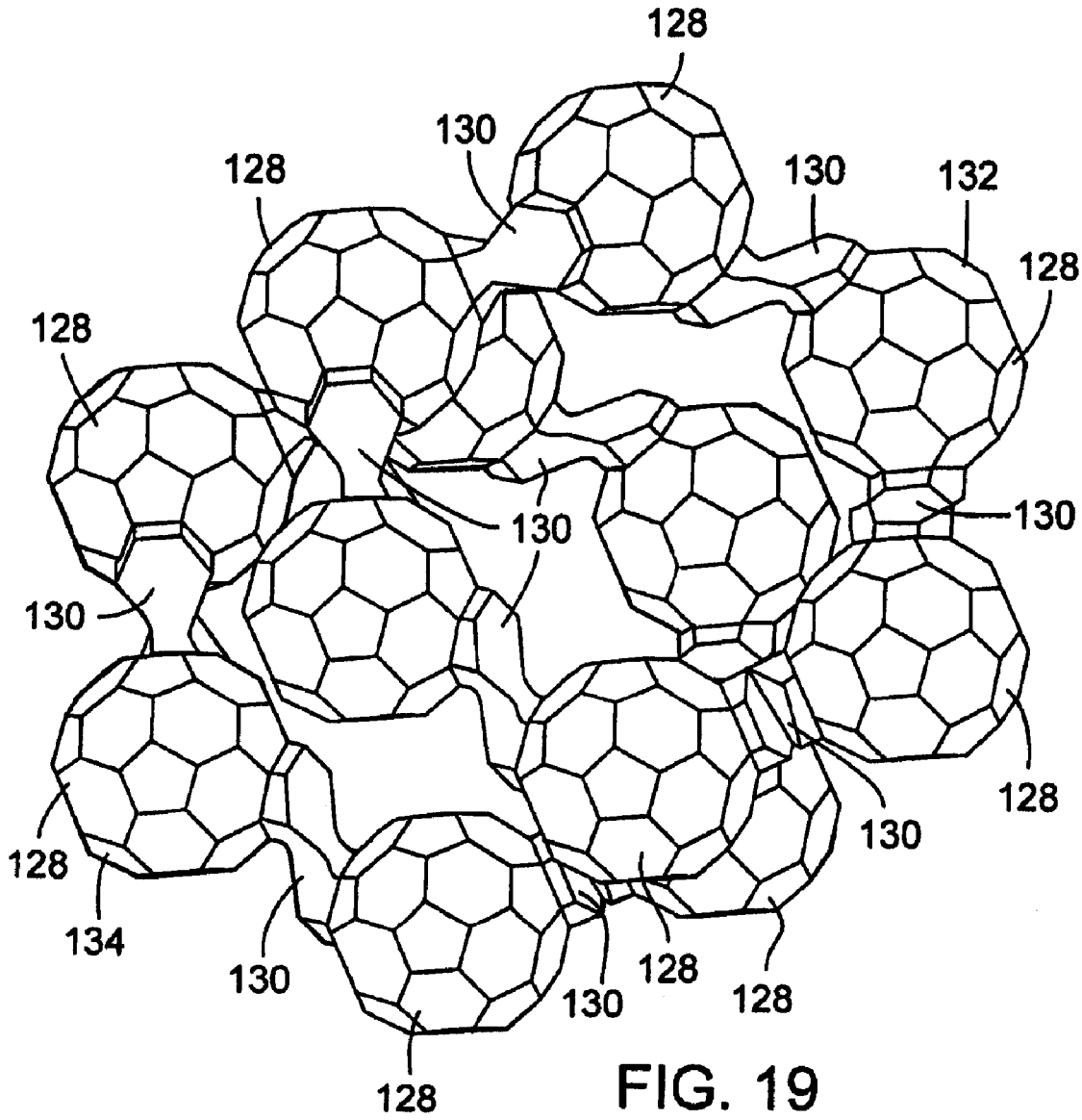
FIG. 19 is a perspective view of the two stacked ring elements of FIG. 18.
Figure 20:
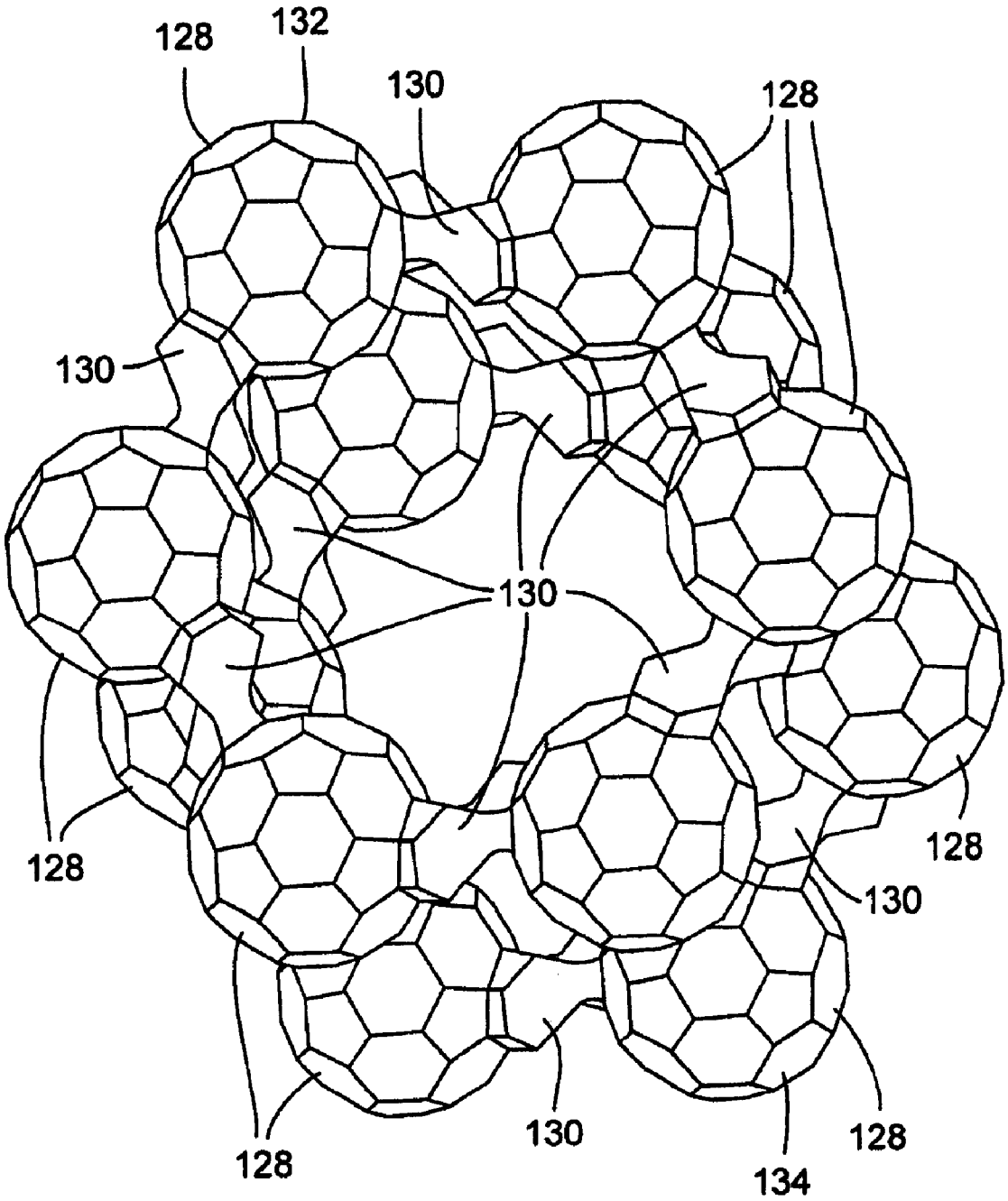
FIG. 20 is another perspective view of the two stacked ring elements of FIG. 18.
Figure 21:
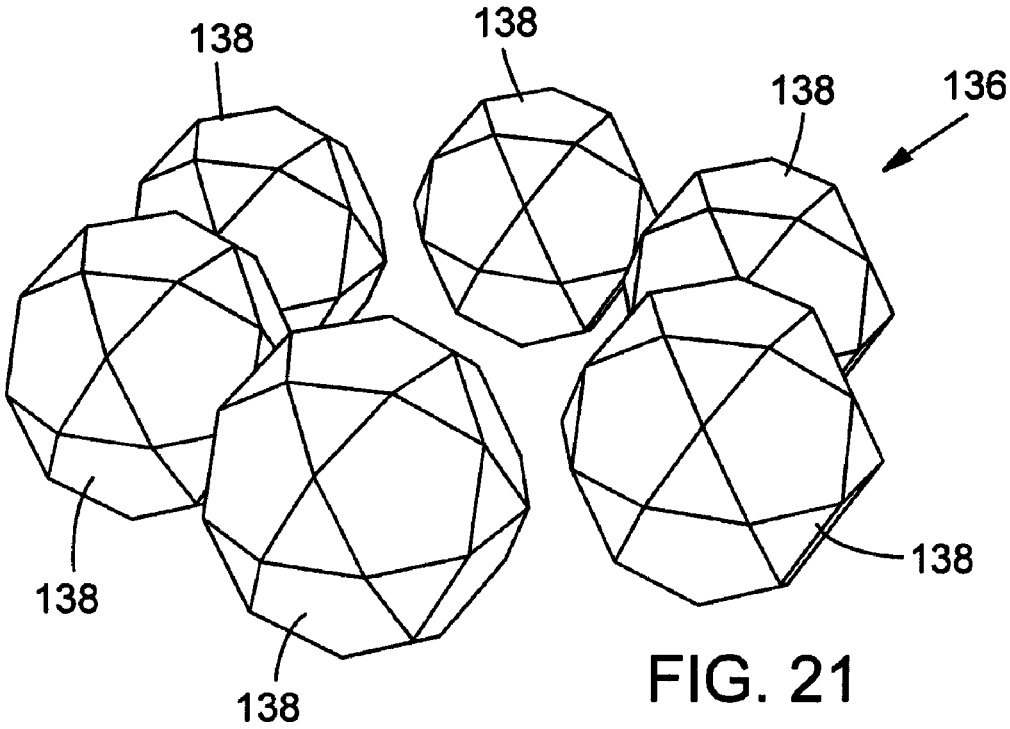
FIG. 21 is a perspective view of a ring element (with connections omitted for clarity) comprising six polyhedroids, with each polyhedroid having a generally icosidodecahedral shape.
Figure 22A:
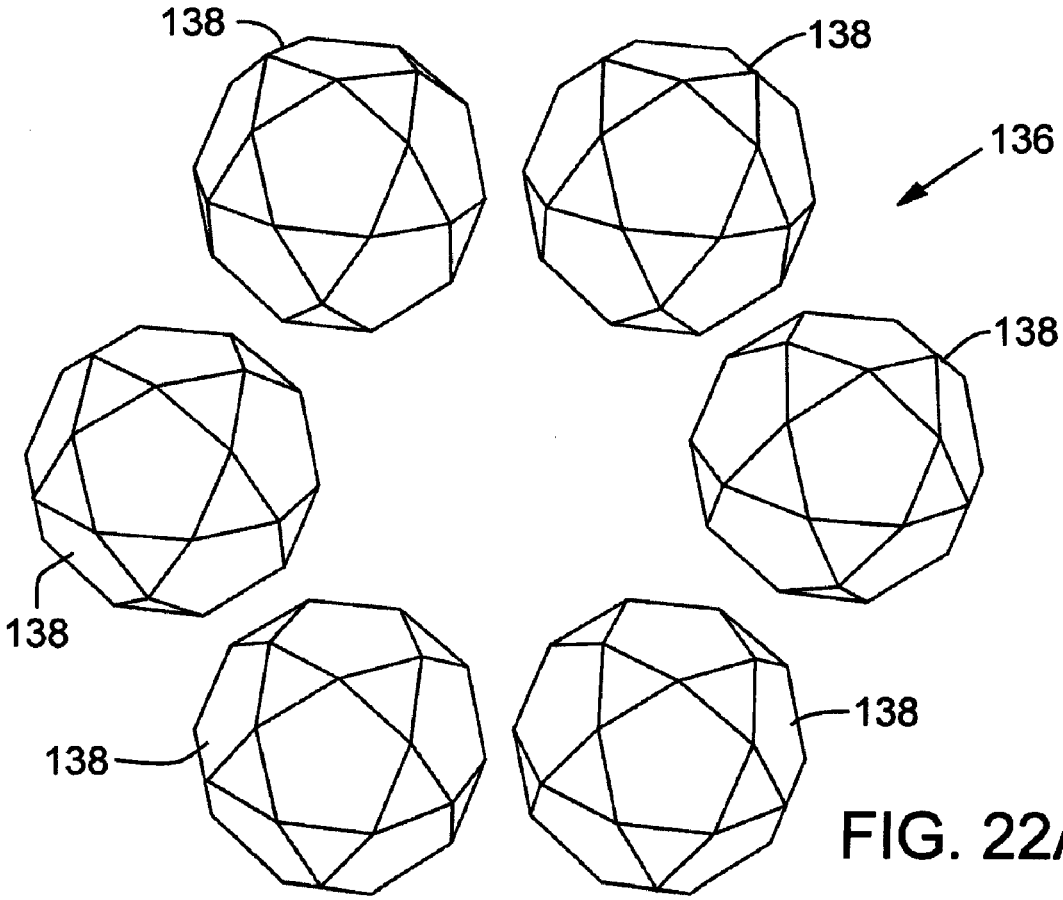
FIG. 22A is another perspective view of the ring element of FIG. 21.
Figure 22B:
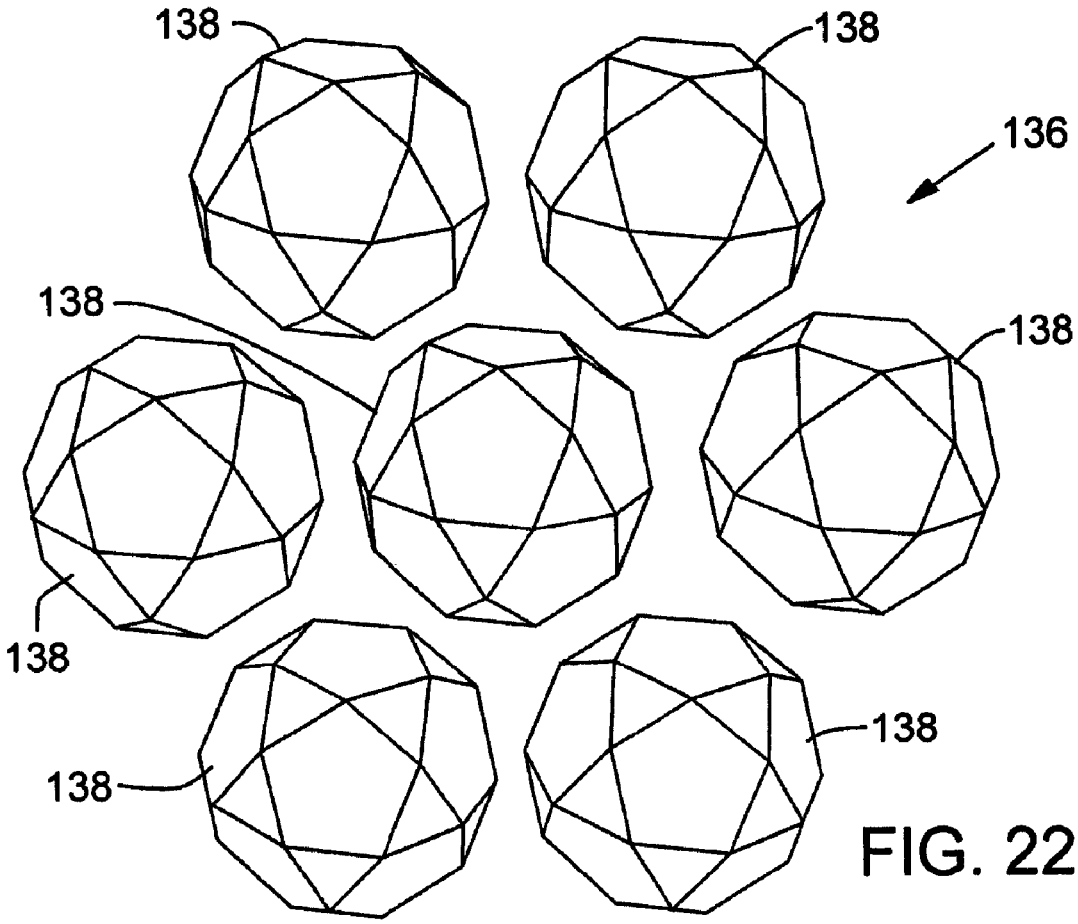
FIG. 22B is a perspective view of the ring element of FIG. 21 shown with a center polyhedroid.
Figure 23:
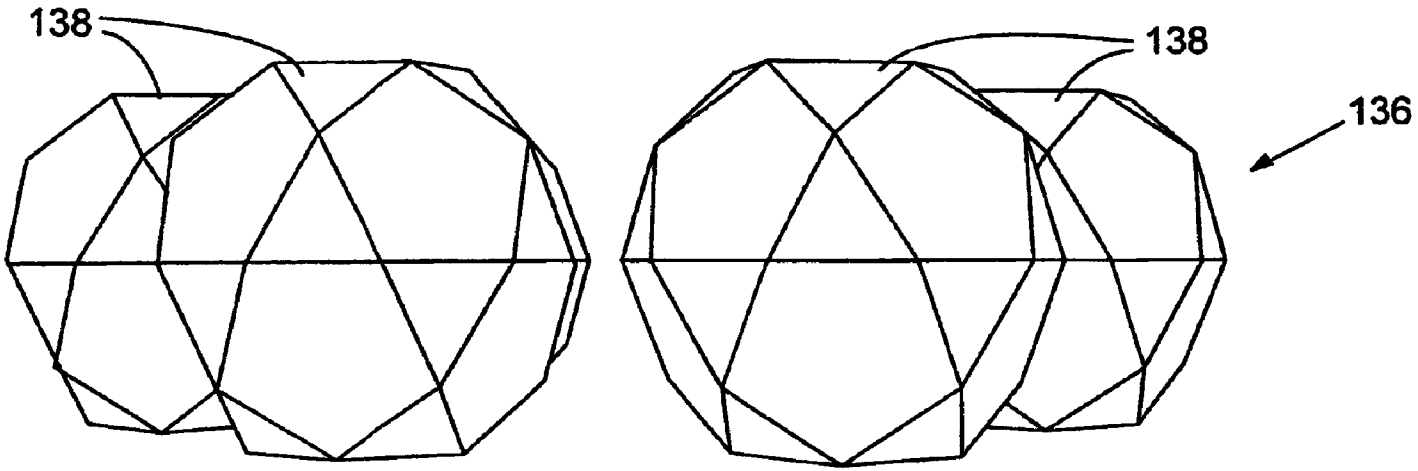
FIG. 23 is a side view of the ring element of FIG. 21.
Figure 24:
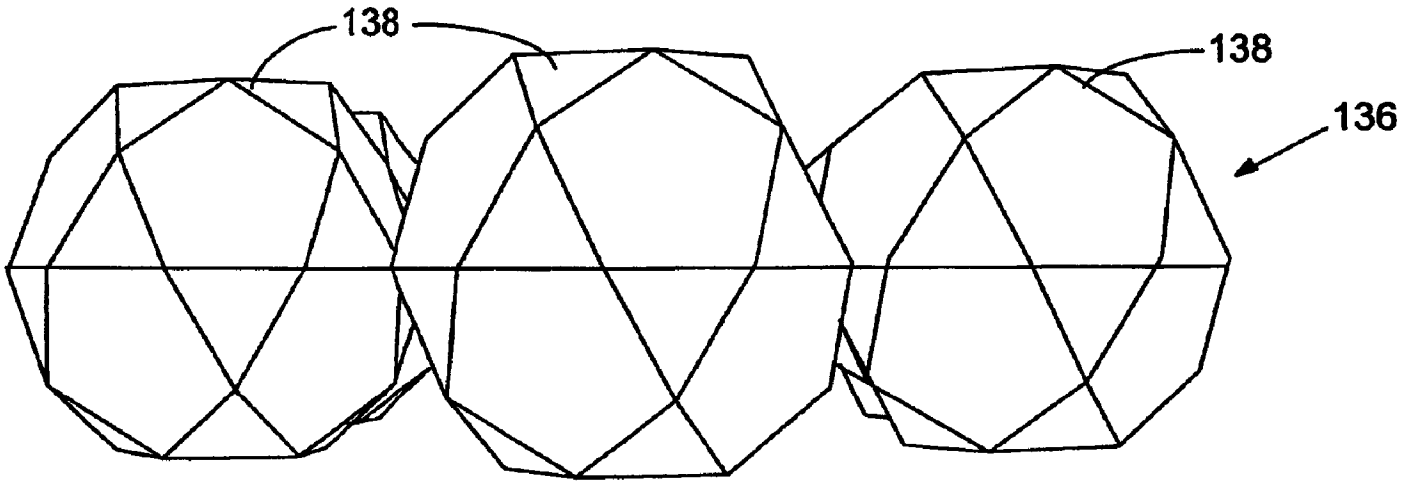
FIG. 24 is another side view of the ring element of FIG. 21.
Figure 25:
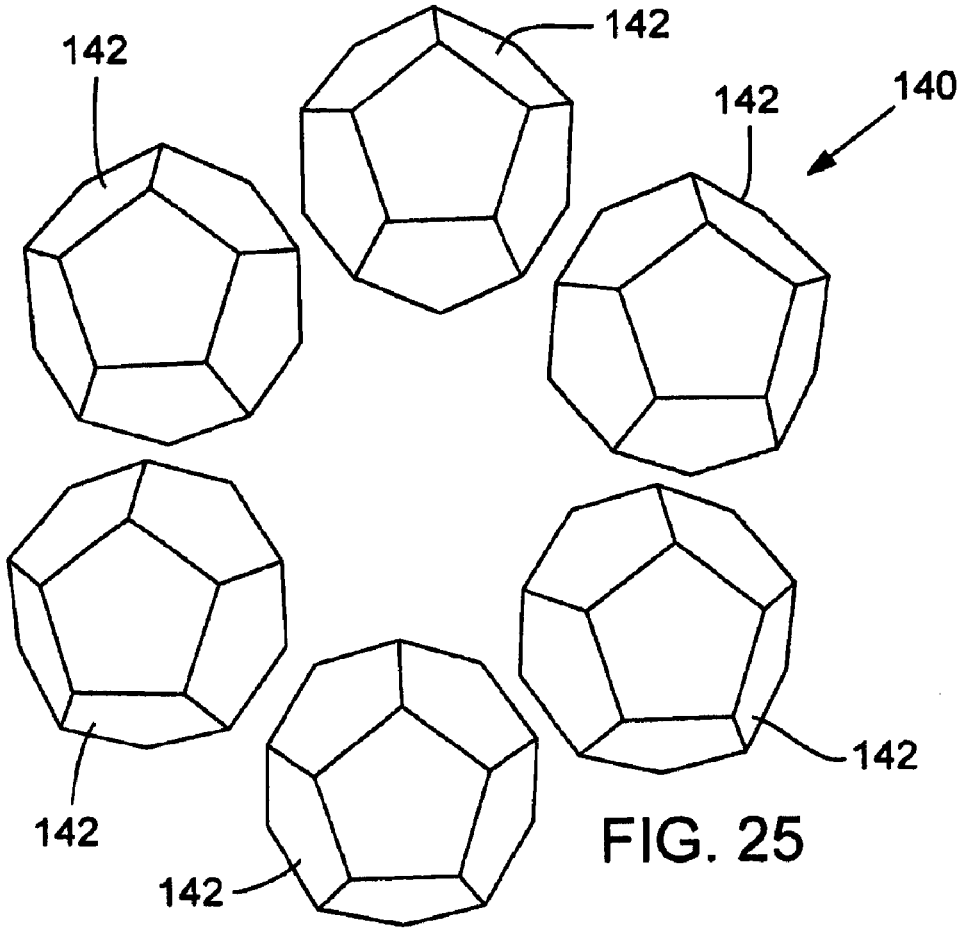
FIG. 25 is top view of a ring element (with connections omitted for clarity) comprising six polyhedroids, with each polyhedroid having a generally dodecahedral shape.
Figure 26:
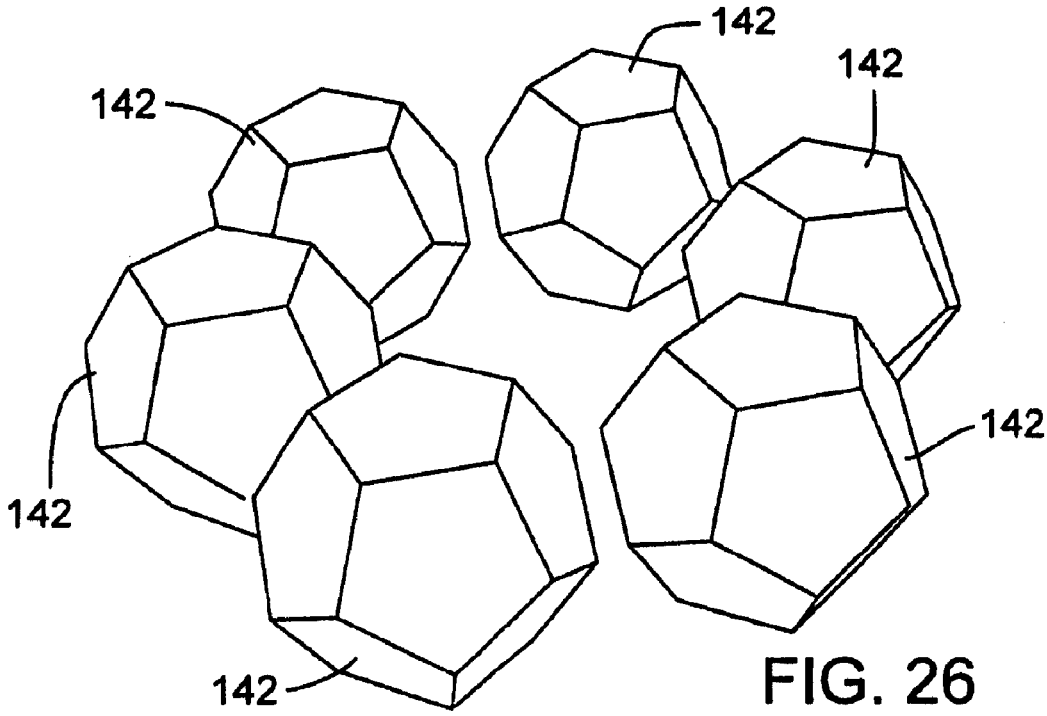
FIG. 26 is a perspective view of the ring element of FIG. 25.
Figure 27:
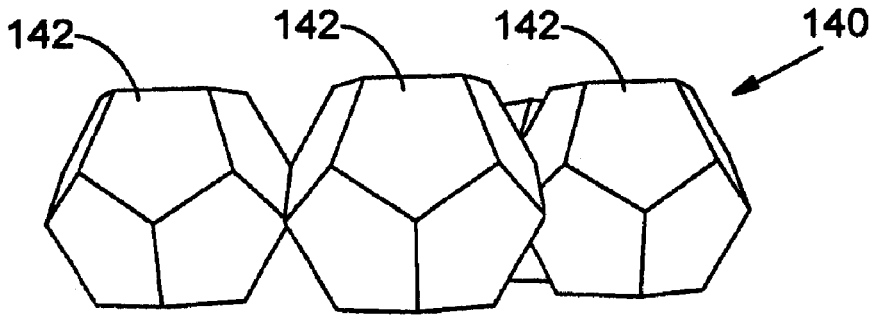
FIG. 27 is a side view of the ring element of FIG. 25.
Figure 28:
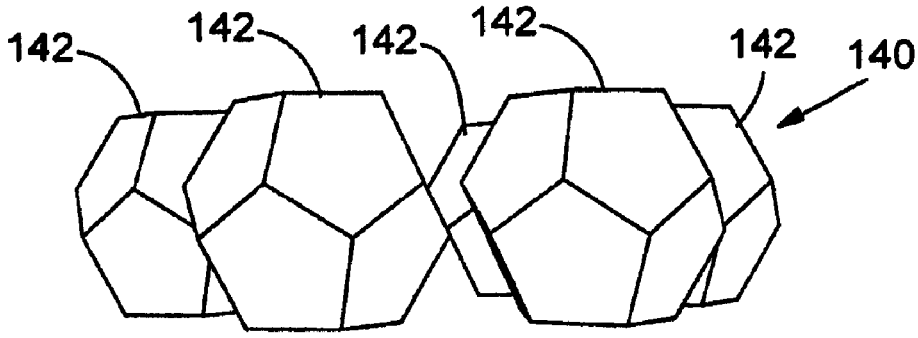
FIG. 28 is another side view of the ring element of FIG. 25.
Figure 29:
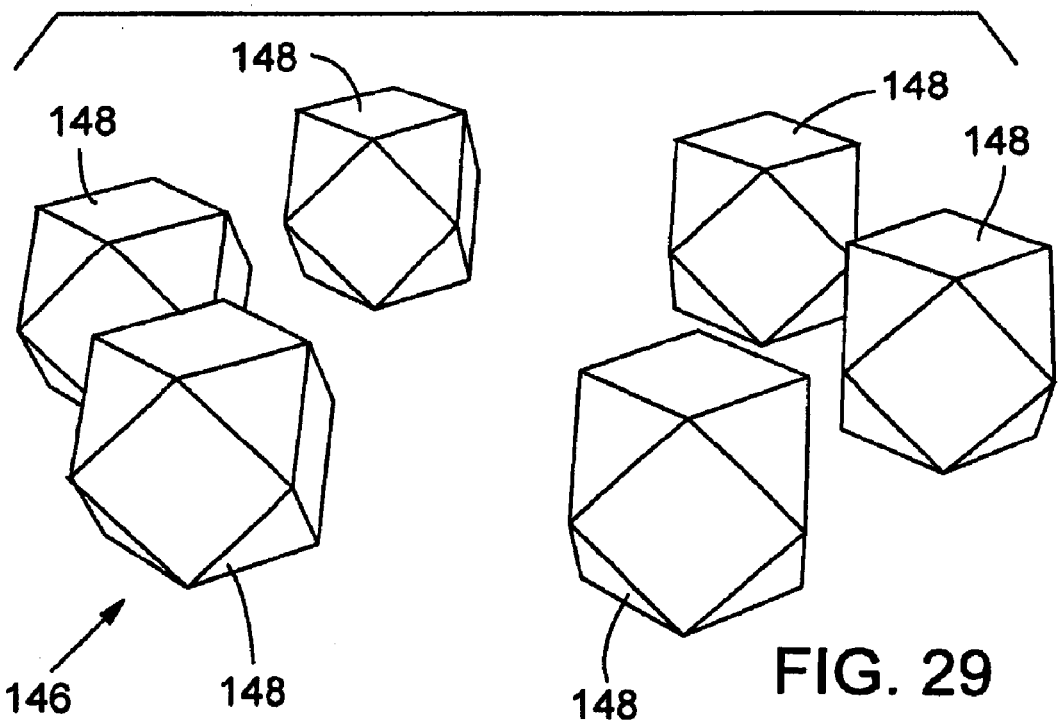
FIG. 29 is a perspective view of a ring element (with connections omitted for clarity) comprising six polyhedroids connected together, with each polyhedroid having a generally cuboctahedral shape.
Figure 30:
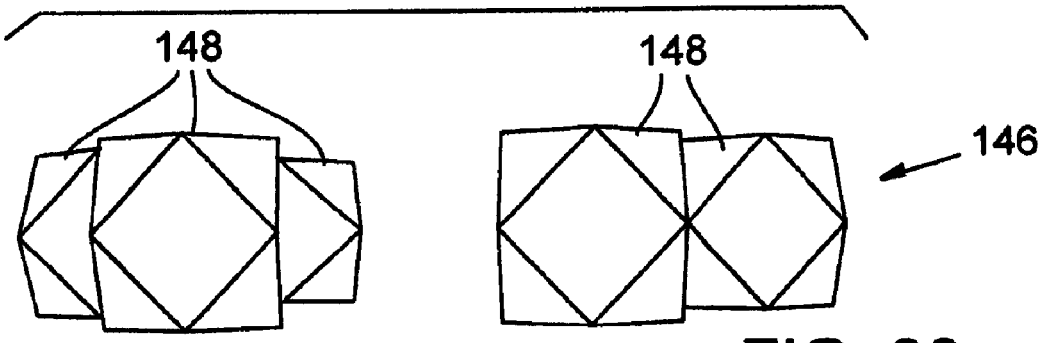
FIG. 30 is a side view of the ring element of FIG. 29.
Figure 31:
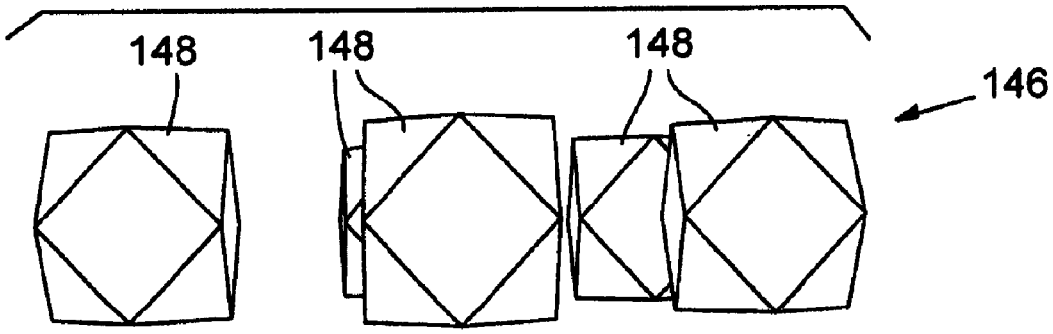
FIG. 31 is another side view of the ring element of FIG. 29.
Figure 32:
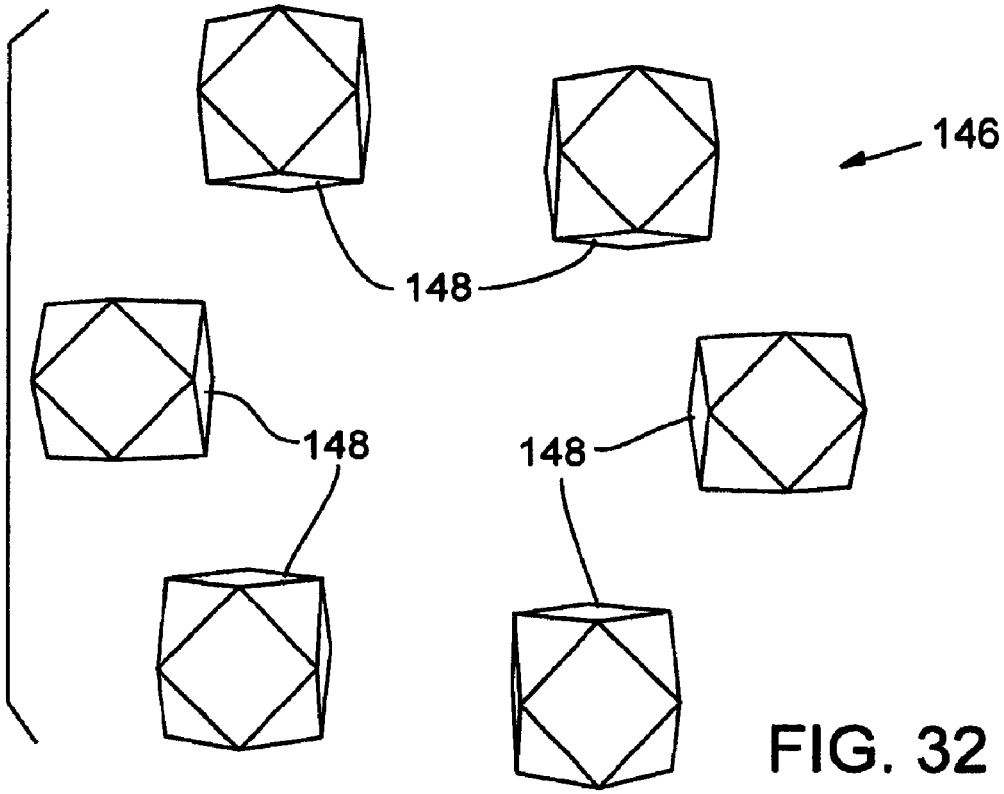
FIG. 32 is a top view of the ring element of FIG. 29.

FIGS. 18, 19, and 20 show a first ring element 132 and a second ring element 134 forming two layers of an array. First and second ring elements 132, 134 both comprise a ring element with six polyhedroids. The polyhedroids 128 are each generally shaped as truncated icosahedrons, as shown in FIGS. 16 and 17. The array formed by first ring element 134 and second ring element 136 includes a connecting mortar element (not shown), which connects the first ring element 134. The mortar element can connect the first and second ring elements in a variety of manners, including by having extending members that extend into openings in the surface of polyhedroids 128, such as described above with respect to FIGS. 8A-8E.

FIGS. 21-24 illustrate a ring element 136 that comprises six polyhedroids 138. The six polyhedroids 138 each have a generally icosidodecahedral shape. The icosidodecahedron has 32 faces (20 triangles and 12 pentagons), 60 edges and 30 vertices. Each of the polyhedroids 138 is connected to two adjacent polyhedroids 138 via connecting members (not shown). The connecting members desirably connect adjacent polyhedroids via one or more their faces, edges or vertices. FIG. 22A shows ring element 136 with an opening in the center of the substantially closed ring shape (i.e., missing a center polyhedroid), while FIG. 22B shows ring element 136 with a polyhedroid in the center of the substantially closed ring shape.

FIGS. 25-28 illustrate a ring element 140 that comprises six polyhedroids 142. The six polyhedroids 142 each have a generally dodecahedral shape. The dodecahedron has 12 pentagonal faces, 30 edges and 20 vertices. Each of the polyhedroids 142 is connected to two adjacent polyhedroids 142 via connecting members (not shown). The connecting members desirably connect adjacent polyhedroids via one or more their faces, edges or vertices.

FIGS. 29-32 illustrate a ring element 146 that comprises six polyhedroids 148. The six polyhedroids 148 each have a generally cuboctahedral shape. The cuboctahedron has 14 faces (8 triangles and 6 squares), 24 edges and 12 vertices. Each of the polyhedroids 148 is connected to two adjacent polyhedroids 148 via connecting members (not shown). The connecting members desirably connect adjacent polyhedroids via one or more their faces, edges or vertices.

The material selection for the ring and mortar elements described above can include virtually any category of materials that is capable of being constructed into the required shapes. For example, plastics, metals, textiles, and wood products can generally be used to form the shapes required.

Furthermore, unlike many construction or structural materials, the array materials can be highly environmentally friendly and reusable. Because the array can be constructed by adding mortar elements and ring elements to the array without mixing materials, epoxies, or other binding agents, the array can also be deconstructed without destroying or damaging the materials of array. Accordingly, the ring elements and mortar can be easily reused, increasing the environmental friendliness of the array and its components.

Of course, if reusability is not an issue, the array can also be more permanently constructed using epoxies or other binding agents. In addition to using epoxies or binding agents in the array itself, the array can also form a structural base for other permanent building materials. For example, concrete could be poured onto an array structure in order to increase the rigidity of the array structure and of the concrete. The open and permeable architecture of the array creates a structure that is easily filled with concrete or other hardening agents.

In addition to fillable materials such as concrete, the open and permeable structure of the array also permits the addition of a variety of other functional elements in the array. For example, the array can be loaded with chemical "beads," wired or wireless addressable locations, circuitry, lighting elements, heating elements, solar cells, seeds, phase-changing materials, and barrier layers.

In addition, a single array can contain or be constructed of varying materials. Thus, for example, a segment of the array could contain more flexible materials than another segment of the array. In this manner, the array can be constructed so that portions of the array are capable of serving or performing different functions. It may also be desirable to have layers that are constructed of varying materials. For example, in constructing a sidewalk, it may be desirable to have a lower foundation layer, a middle heated layer, and a top traction layer. Each of these layers can be constructed of a different material. By creating the array of varying materials (that is, with the materials of the ring elements, mortar elements, and/or combination of ring and mortar elements varying), the array can be designed to be anisotropic, with structural, electrical, or other physical properties varying along each of its three axes in the Cartesian coordinate system.

As noted above, the array can also be constructed in very small scale, such as at the nanoscale or microscale. In some cases, it may be desirable to construct the array of naturally or non-naturally occurring molecular forms which have the specific polyhedral geometry discussed above. For example, the $C_{60}$ molecule is a truncated icosahedron and the $B_{12}$ molecule is an icosahedron. Work in the area of these and similar molecules is represented by U.S. Pat. No. 6,531,107, U.S. Pat. No. 6,965,026, U.S. Patent Publication No. 2001/0016283, each of which is incorporated herein by reference. Assembly of such molecules into the structured and ordered arrays that contain ring elements as disclosed above, can be achieved by various assembly techniques such as atomic force microscopy, self assembly, or other techniques discussed in the patent documents incorporated by reference above. Such molecular arrays can include molecular structures forming ring elements (as noted above) and the mortar elements can include, for example, connecting elements that are formed of molecules, ligands, ligatures, and other such structures capable of generally maintaining the respective positions of the ring elements in the overall array.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

I claim:

1. An apparatus comprising:

at least one ring element, the ring element comprising:

a plurality of spaced-apart polyhedroids, each polyhedroid having the same general geometric shape; and a plurality of connecting members, the connecting members connecting each polyhedroid to at least two adjacent polyhedroids so that the plurality of polyhedroids form a closed ring shape;

at least one mortar element comprising a base element with first extending members extending upwardly from the base element and second extending members extending downwardly from the base element, the mortar element connecting at least two ring members together so that the ring elements are substantially held in position relative to one another;

wherein six polyhedroids define the closed ring shape, wherein each polyhedroid has the same general geometric shape, and the geometric shape is selected from the group consisting of Platonic polyhedrons and Archimedean polyhedrons;

wherein the ring element does not have a polyheroid in the center of the ring element.

2. The apparatus of claim 1, wherein the geometric shape of the polyhedroids has 5-fold symmetry.

3. The apparatus of claim 2, wherein the geometric shape of the polyhedroids is an icosahedron or truncated icosahedron.

4. The apparatus of claim 1, wherein the apparatus comprises at least a first ring element and a second ring element, and wherein the first ring element is capable of being coupled to a first side of the mortar element and the second ring element is capable of being coupled to a second side of the mortar element.

5. The apparatus of claim 4, wherein the mortar element comprises a first extending member extending from the first side of the mortar element to couple the mortar element to the first ring element and a second extending member extending from the second side of the mortar element to couple the mortar element to the second ring element.

6. The apparatus of claim 5, wherein the polyhedroids have a generally icosahedral shape, with the upper face having three edges, and wherein each edge of the upper face forms an edge of an adjacent upper face, the adjacent upper faces form the openings into which the first extending members extend.

7. The apparatus of claim 6, wherein the base member comprises a first triangular element and a second triangular element, the first and second triangular elements being interconnected and each having three edges; and wherein the first extending members extend upwardly from the three edges of the first triangular element and the second extending members extend downwardly from the three edges of the second triangular element.

8. The apparatus of claim 1, wherein each polyhedroid further comprises an upper face, the upper face being the uppermost surface of the polyhedroid, and wherein the mortar element further comprises a facing element, the facing element having the same general geometric shape as the upper face of the polyhedroids and being configured to contact the upper face when the ring element is connected to the mortar element.

9. The apparatus of claim 1, wherein the ring element has an opening in the center of the closed ring shape.

10. The apparatus of claim 1, further comprising a structured and ordered array of at least two layers, wherein a first array layer comprises a plurality of ring elements and a second array layer comprises a plurality of ring elements.

11. The apparatus of claim 10, wherein the array is omni-extensible.

12. The apparatus of claim 10, wherein the array can be increased in size by connecting additional ring elements and mortar elements without other modifications to the array.

13. The apparatus of claim 10, wherein the ring elements are arranged in multiple, generally parallel layers.

14. The apparatus of claim 10, wherein each ring element is offset from a ring element that is above or below it in an adjacent parallel layer.

15. The apparatus of claim 10, wherein the at least one mortar element comprises at least one spanning mortar element, the spanning mortar element being configured to connect two ring elements in a single parallel layer.

16. The apparatus of claim 15, wherein the at least one spanning mortar element also connects the two ring elements to another ring element that is above or below it in an adjacent parallel layer.

* * * * *